US006863152B1

(12) United States Patent
Sahyoun

(10) Patent No.: US 6,863,152 B1
(45) Date of Patent: Mar. 8, 2005

(54) LOW PROFILE AUDIO SPEAKER

(76) Inventor: Joseph Yaacoub Sahyoun, 3031 Hopkins Ave., Redwood City, CA (US) 94062

( * ) Notice: Subject to any disclaimer, the term of this patent is extended or adjusted under 35 U.S.C. 154(b) by 0 days.

(21) Appl. No.: 10/675,853

(22) Filed: Sep. 30, 2003

Related U.S. Application Data

(60) Division of application No. 10/058,868, filed on Jan. 28, 2002, now Pat. No. 6,675,931, which is a continuation-in-part of application No. 09/542,155, filed on Apr. 4, 2000, now Pat. No. 6,460,651, which is a continuation-in-part of application No. 09/201,398, filed on Nov. 30, 1998, now Pat. No. 6,044,925.

(51) Int. Cl.[7] ..... G10K 13/00; H04R 7/12; H04R 1/16; H04R 9/06; H04R 11/02

(52) U.S. Cl. ..... 181/157; 181/166; 181/172; 381/398; 381/405

(58) Field of Search ..... 181/157, 166, 181/171, 172, 150, 161; 381/394–396, 398, 400, 404, 405

(56) References Cited

U.S. PATENT DOCUMENTS 5,847,333 A * 12/1998 D'Hoogh ..... 181/171
5,909,015 A * 6/1999 Yamamoto et al. ..... 181/156
6,176,345 B1 * 1/2001 Perkins et al. ..... 181/173
6,487,300 B1 * 11/2002 Lee et al. ..... 381/396
6,513,623 B2 * 2/2003 Sugiyama et al. ..... 181/161

* cited by examiner

*Primary Examiner*—Shih-Yung Hsieh
*Assistant Examiner*—Edgardo San Martin
(74) *Attorney, Agent, or Firm*—Allston L. Jones

(57) ABSTRACT

A symmetrically loaded, shallow suspension speaker with stiff diaphragm having a minimum dimension that is greater than the diameter of the magnet that drives the diaphragm thus allowing the suspension of the diaphragm to extend nearly to the bottom of the speaker basket on the maximum inward excursion of the voice coil and diaphragm such that the suspension operational depth is not the limiting factor of the overall height of the speaker. The elements of the suspension system are designed to maximize the spacing between the inner and outer portions of the suspension, thus minimizing the possibility of wobble in the speaker. The speaker design maximizes air movement in a given mounting depth with a configuration that optimizes the operation of the moving parts that complements the fixed mechanical structural configuration of the non-moving parts in either an overhung or underhung configuration. The design also accommodates user replacement of the voice coil or cone.

10 Claims, 34 Drawing Sheets

232
230
236
234

242
246
240
236
238
234

252
248
246

254
252

LOW PROFILE AUDIO SPEAKER

RELATED U.S. APPLICATIONS

This is a divisional of application of a application of the same title having Ser. No. 10/058,868 , filed Jan. 28, 2002, that issued as U.S. Pat. No. 6,675,931, on Jan. 13, 2004, which is a Continuation In Part application of application having Ser. No. 09/542,155, filed Apr. 4, 2000, that issued as U.S. Pat. No. 6,460,657, on Oct. 8, 2002, which is a Continuation In Part application of application Ser. No. 09/201,398, filed Nov. 30, 1998 that issued as U.S. Pat. No. 6,044,925, on Apr. 4, 2000.

BACKGROUND OF THE INVENTION

1. Field of the Invention

This invention relates to loud speakers and in particular to the construction of low profile audio speakers.

2. Description of the Related Art

A goal of sound reproduction equipment is to provide a life-like sound quality to the listener. Lifelike sound quality is understood to be best achieved when a sound system including the speakers have a flat frequency response curve throughout the range of sound frequencies audible to the human ear, generally 20 to 20,000 Hz. A normal speaker cabinet has an electro magnetically driven speaker cone sealed to an opening in the wall of a sealed cabinet. This arrangement provides a drooping frequency response curve (e.g., 22 in the graph 20 of FIG. 1).

The graph 20 of FIG. 1 represents a comparison of sound level verses frequency (i.e., frequency response). The plot 22 shows the drooping response for a closed cabinet system. Over the years, in an effort to improve sound quality low, mid, and high range speakers have been placed in separate cabinets or compartments. Each of those separate cabinets or compartments could then be tuned by creating ports, with or without tubes, in the cabinet to improve the frequency response. At low frequencies, the use of open ports, or open ports and tubes, in the speaker cabinet becomes unmanageable because of the large air mass that needs to be moved to provide adequate tuning. As an example, an ideal cabinet size to hear low frequencies might be larger than the room in which the listener was sitting.

In an effort to offset the effects of a rigid sealed cabinet and avoid the spatial requirements necessary when attempting to create ports or tube ports with speakers low frequencies, passive radiators (generally configured like speakers, but without the electro mechanical driver) have been placed in a secondary opening of the walls of the speaker cavity to reduce the drop-off of the loudness at low frequencies. An example of the improvement in the frequency response when such a passive radiator is installed is shown as plot 24 in FIG. 1. An example of the improvement in the frequency response attributable to the installation of a prior art passive radiator can be understood by reviewing plot 26 in FIG. 2. Note that the drop in the frequency response curve at lower frequencies in plot 26 is very severe before the range of inaudible frequencies 28 is reached. In this configuration, AREA2, the area under the curve to the right of the peak above a minimum loudness level, is larger than AREA1which is the area under the curve to the left of the peak. This imbalance is indicative of the relative distortion that can be heard as the loudness of the passive radiator nosedives and falls below an audible loudness. The low frequency loudness and energy are not balanced with the high frequency loudness and energy. The area under the curves provide a measure of the imbalance.

Recent trends in the audio systems market have been leaning towards enhancing the bass or sub-woofer response of the audio reproduction systems, so that even if a sound is below the low limit of the range of audible sound, the sound level is high enough so that the listener, although he or she cannot "hear" the sound with ears, they can "feel" the sound as parts of their body are hit by the low frequency waves. At low frequencies, a limitation of passive radiators has been that the low frequencies require large displacements of the moveable radiator elements. Such large displacements can exceed the available range of motion of moveable radiator elements. For example. In FIGS. 4, 5 and 6, a speaker spider 62 at its perimeter is attached to the back end of a speaker basket 50 while the spider's center edge (or core) it is attached to the back end of a speaker cone 58 or a diaphragm 68 to spider 72 connection element 74. In each pictured radiator, a central moveable element is suspended by a speaker "surround" (52, 70, 84) which acts as the flexible element between the stationary front of the speaker basket (50, 66, 80) and the speaker moveable element. Because the range of travel available from each spider (62, 72, 88) is less than the range of travel available from the surround (52, 70, 84), as the spider (62, 72, 88) reaches the limit of its travel and stops. The sudden stop in the movement of the spider, due to its full extensions, causes distortions in adjacent components as well as in the pressure gradients in the speaker chamber. These distortions can be heard as static and/or unnatural discontinuities in the sound. The ratio of the speaker basket back opening "B" (which supports the spider) to the speaker basket front opening "A" (which supports the surround) is approximately 0.5 (or 50%).

In the instance when a passive radiator constructed solely of a speaker cone is connected only as its peripheral rim to an annular support surface in the wall of a speaker, for example, as shown in the to Klasco U.S. Pat. No. 4,207,963, a larger range of travel is available to accommodate large movable element displacements experienced at high volume and low frequencies. However, the use of a surround around the perimeter of the top of the cone and the cone shape produces cone wobble which also distorts the sound. The object of the Klasco patent was to arrange active elements to reduce the wobble in the passive radiator.

In the instance where a lone speaker cone suspended in a cavity opening is used, the response of the passive radiator during low frequency cycles as the cone is forced outward and pulled inward can be non-linear as the flexible member (surround) holding the cone tends to have different non-linear force to displacement characteristics when being stretched outwardly as compared to when it is being stretched inwardly.

The limitations on travel as shown in the prior art described in FIGS. 4, 5 and 6 and the wobble of a passive radiator as discussed in the Klasco patent and such a configuration's non-linearity, highlight the shortcomings of the prior art passive radiators.

The spatial requirement of the prior art passive radiators is also a drawback. The prior art passive radiators are quite large and bulky and extend a large distance into any sealed cavity. This spatial requirement must be taken into account when designing features and companion speakers to fit into the sealed cavity.

Recently there has been an increasing demand for loudspeakers for use in a very compact/shallow space. This demand was born by consumer appetite for louder sound grew couple with the desire for less obtrusive speakers. Recently, home audio consumers have begun a major shift from larger, conventional loudspeakers housed in cabinets that stand alone in the room—to smaller piston speakers that mount within the wall of a house. The available depth in in-wall locations is dictated by the use of 2×4 studs during construction thus creating a space that is less than 4" deep.

This need for shallow, low profile speakers are not limited to meeting the home audio demand. Such low profile speakers also have application in cars, boats, airplanes and other locations that will benefit from the depth reduction without taxing the sound pressure level. In cars for example, the available mounting depth behind the door panel is much less than the minimum height of conventional speakers. In order to use conventional speakers in such locations, it is nearly always necessary to use a raised grill cover over the speaker since it necessary to have a portion of the speaker heigh extend above the surface of the door panel into the passenger compartment.

For the most part, subwoofer construction has followed conventional technology the use of an oscillating diaphragm that responds to a varying magnetic field developed by an applied audio signal. That varying magnetic field causes the diaphragm to be attracted and repelled to and from the intermediate position where the diaphragm rests when no audio signal is applied to the speaker. For the most part, current speaker technology uses a loudspeaker made of a rigid diaphragm, or "cone", suspended within a speaker frame, or "basket" around the outer edge with a flexible membrane, or "surround". This membrane allows the cone to move inward and outward when driven by a varying magnetic field resulting from the application of an audio, or "music", signal applied to the speaker.

Over the years speakers have been designed with a convention structure—a cone connected to the outer part to a speaker frame, or basket, through a flexible membrane (surround). To develop a back-pressure wave and to control axial movement of the cone, designer installed a secondary part called a "spider" that also connects the inner part of the cone to the speaker frame. Almost all spider materials used are made of cloth that has been treated and pressed in a heated die to form the shape of the spider that was sought. Conventional speakers require a huge mounting depth that render them useless in shallow spaces where consumers now wish to place speakers. For example, a conventional 10" diameter speaker, with an excursion of +/−1" requires a mounting depth of at least 7". Moreover 12" diameter conventional speakers requires a mounting depth of at least 7" to 8". Hence conventional speakers clearly will not fit in shallow spaces, such as walls where the mounting depth is limited to about 3.5", or less, unless a smaller diameter conventional speaker is used. Thus, consumer demand has created a need that conventional speakers can not meet and still provide the performance desired by the consumer. Therefore there is a need to develop loudspeakers that have a large piston area with a minimum mounting depth. Low profile speakers designed using the present invention meet that need.

SUMMARY OF THE INVENTION

An embodiment according to the invention overcomes the drawbacks of the prior art by providing a generally linear response by configuring two speaker surrounds opposite one another so that any non-linearities in the spring constant between an outward displacement versus an inward displacement are generally cancelled and a pseudo linear spring constant is developed throughout the central range of travel of the passive radiator moveable elements.

In an embodiment according to the invention an inner surround encircles and has an inner edge fixed to the perimeter of an inner center member which is generally a flat disk and may be a flat disk diaphragm. The arch of the surround between the inner edge and the perimeter edge of the inner surround extends in a first direction. An outer surround encircling and having an inner edge fixed to the perimeter of an outer center member is configured so that its arch extends in a second direction which is opposite the first direction. A connection member or mass is fixed to and between the inner center members and the outer center member causes the two to move together and in parallel. The connection member may be a specially sized mass to tune the passive radiator for resonance at a particular frequency.

Variations of embodiments according to the invention include using a ratio of the size of the inner center member to the outer center member or outer center member to the inner center member of between 0.8 and 1, the calculation of the ratio will be such that the rat o will always be 1 or less. Another embodiment provides the inner central member and outer central member to be connected and integral as one piece with an annular spring (elastic) member between the central integral inner and outer member core and the surrounding speaker frame opening. A cut out section of the wall of the speaker cabinet, for example can form the central diaphragm core, and the application of an elastic flowable substance that can be formed in place to form an elastic bond between the core and the surrounding support frame (usually a hole in the speaker cabinet) by using a formable elastic substance that can be formed into a desired shape in flowable gel or liquid type state. Where the flowable substance sets up to have acceptable elastic qualities such as might be found when using a spider or surround of the current design in that location.

A further aspect of the invention involves structures and methods which enhance embodiments according to the invention by eliminating high pressure air between surround rolls during long strokes of the passive element by providing an air vent system. This system prevents creation of a high-pressure secondary air cabinet that slows the response.

A still further aspect of the invention relates to the utilization of multiply configured concentric surrounds in a long stroke passive speaker configuration to provide a high quality sound without noticeable group delay while still providing high SPL (sound pressure levels). A progressive roll passive system utilizes progressively smaller surround roll diameters to achieve high sound pressure levels with minimal distortion with a short overall height.

Another aspect of the present invention builds on the invention embodiments discussed above to provide a symmetrically loaded, shallow suspension speaker. In the speaker embodiments of the present invention, the symmetrically loaded, shallow suspension supports a substantially stiff diaphragm that functions similarly to the "cone" of the prior art. In the present invention the diaphragm, or cone, is made of a material such as honeycomb, thin aluminum, and other composite and non-composite light-weight materials; conventional cone materials will not work in this application since the diaphragm is substantially flat and light-weight. This flat diaphragm is suspended by the outermost edge with a suspension system that is entirely outside the diameter of the magnet, thus allowing the suspension to extend to nearly the bottom of the speaker basket on the maximum inward excursion of the voice coil and diaphragm. Thus, the suspension operational depth is not the limiting factor of the speaker basket design and the actual mounting depth of the speaker. Note that mounting depth and cone wobble control are interrelated in the speakers of the present invention; the closer the outer portion of the suspension is to an inner one, the chance of wobble increases as the the mounting depth of the speaker becomes shallower. As will be seen below in the detailed description of the various embodiments of the present invention, the elements of the suspension system of the present invention have been designed maximize the spacing between the inner and outer portions of the suspension system, thus minimizing the possibility of wobble in the low profile speakers of the present invention.

The various embodiments of the present invention permit the designer to maximize air movement in a given mounting depth with a configuration that optimizes the operation of the moving parts (i.e., diaphragm, suspension and voice coil) in the electromagnetic environment that complements the fixed mechanical structural configuration of the non-moving parts. In one embodiment, this invention allows the designer to have an over excursion (outward/inward limiter) that is optimized with the available mounting depth. For example, the present invention allows the designer to have a 15" diameter speaker that fits in a mounting depth of as little as 3.5" with a diaphragm excursion of approximately ±1", while a conventional speaker with the same size working piston requires a mounting depth of 6" to 7".

The present invention also includes several embodiments that allow the user of the speaker to replace the voice coil, or the voice coil and the cone or diaphragm, should they becomes damaged. This would be an attractive option for performers that have a speaker fail during a performance when a speaker is over-driven or dropped.

DETAILED DESCRIPTION

Figure 7:
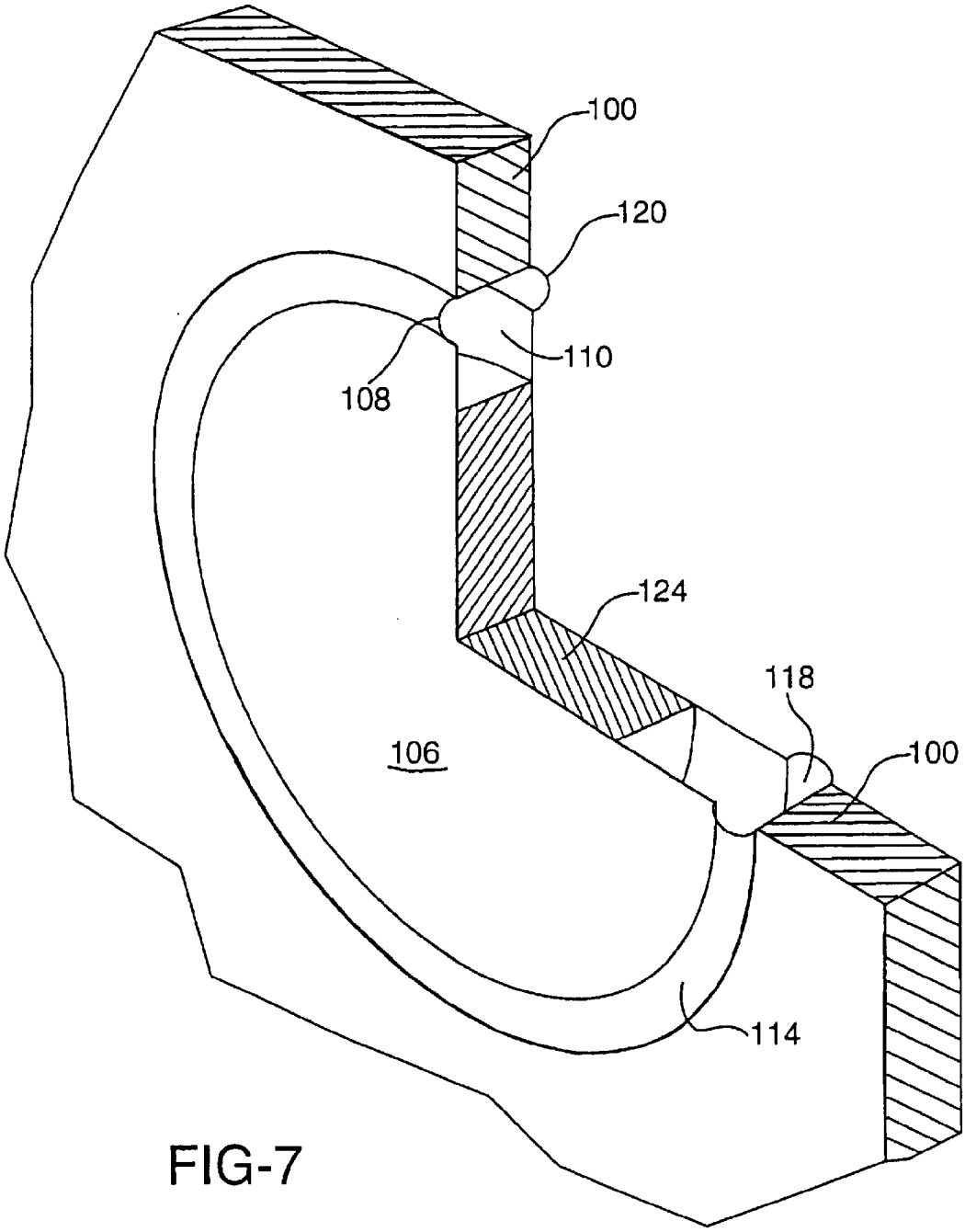
FIG. 7 shows an isometric cut away view of a configuration according to the invention.
Figure 8:
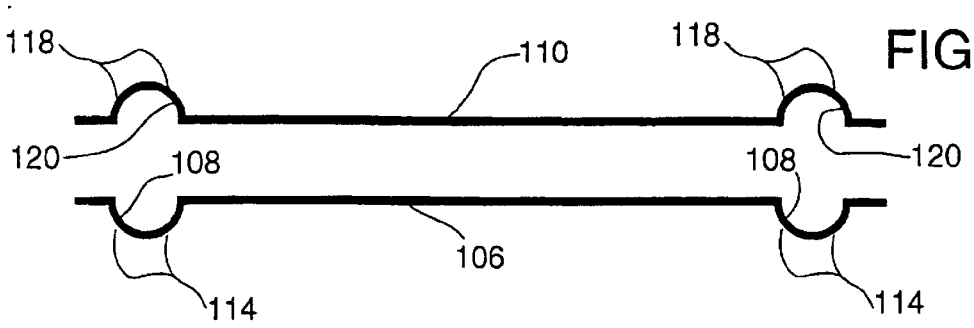
FIG. 8 shows a cross-sectional view of a diaphragm plate fixed to a surround which in turn is fixed to an external ring. Prior to their assembly into a configuration according to the present invention.

An embodiment according to the invention is shown is FIG. 7. A speaker box which acts as an integral speaker support ring 100 is a circular opening in a speaker box. To the speaker box at one edge of its wall is attached an inner surround 114 which has at its inner perimeter an inner diaphragm 106. At the outer wall of the speaker box 100, an outer surround 118 is attached with its inner perimeter fixed to an outer diaphragm 110. A connecting member (or mass) 124 is fixed between the two diaphragms 106, 110 so that the two move together in parallel as the sound pressure due to the frequencies in the sealed box causes the displacement of the two diaphragms simultaneous and in parallel. The inner and outer surrounds 114, 118 are configured so that the arch of 108 of the inner surround projects inwardly while the arch 120 of the outer surround 118 projects outwardly. In short, the center diaphragms 106, 110 and connection member 124 are supported only by the surrounds 114, 118 and the arches 108, 120 of the surrounds project in opposite directions.

In a normal speaker configuration where only one surround is used. e.g., at the perimeter of a speaker cone, there is a non-linear characteristic in the restoring force relative to displacement for a normal half circle type surround. The restoring force is the force that restores the speaker assembly to its neutral position for example during transportation and/or when the speaker is not in use. The non-linearity of the stressing of the inside surface of the arch versus the outside surface of the arch as the surround is stretch by the displacement of a center disk or speaker cone creates a small but detectable distortion. In such arrangements increased air pressure due to the sound waves does not move the diaphragm at the same rate when subject to similar pressure gradients, but rather the air starts to become compressed and generate reflected pulses as a result of the non-movement or slower movement of the diaphragm due to the different displacement rates. As the diaphragm in the passive radiator is exposed to air pressure due to sound volume, the use of two oppositely facing surrounds provide an effective compromise and an improvement over the use of the single surround by providing an approximately linear pressure to displacement relationship irrespective of whether a sound wave is positive (for example, causing the diaphragm to move out) or negative (for example, causing the diaphragm to move inward).

Figure 10:
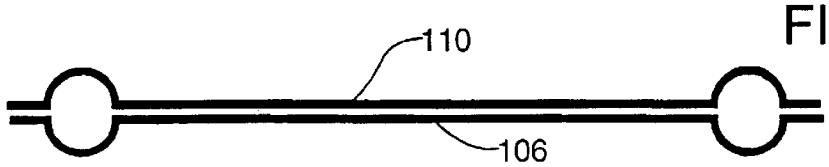
FIG. 10 shows a configuration according to the invention where the two diaphragm plates are fixed one to the other.
Figure 11:
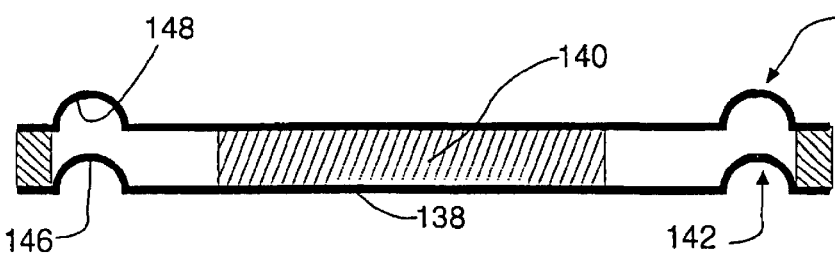
FIG. 11 shows an alternate configuration according to the invention where the arches of the speaker surround project in the same direction.

The use of two oppositely facing surrounds which are fixed to each other and with virtually no separation, for example, as shown in FIG. 10 provide a benefit over the prior art in that the spring constant in the full range of travel from the extreme negative through the neutral (or balanced condition) position to the extreme positive is much closer to linear than when using a single surround alone. However, in the configuration of FIG. 10, wobbling (defined as non-uniform displacement of the diaphragm) of the surround around its perimeter, for example, if a sound pressure wave were to come not perpendicularly into the diaphragm but at an acute angle from one side, then one side of the diaphragm could be preferentially displaced more than the other side at least momentarily this wobble could cause an undesired reflective wave and sound interference which is out of phase with the primary frequency. However, in instances where such a passive radiator is mounted directly opposite a single driver or a group of generally symmetrically arranged drivers, e.g., as in the Klasco patent discussed above, the configuration of FIG. 10 provides a noticeable if not distinct advantage over configurations where only a single surround using a speaker cone is used. Further, the flat surface of the diaphragm provides no transverse surface against which a transverse component of a pressure wave vector could cause lateral translation of the diaphragm as it could in a the prior art where the speaker cone provides a substantial laterally extending surface, which accentuates any wobble that is experienced.

Figure 9:
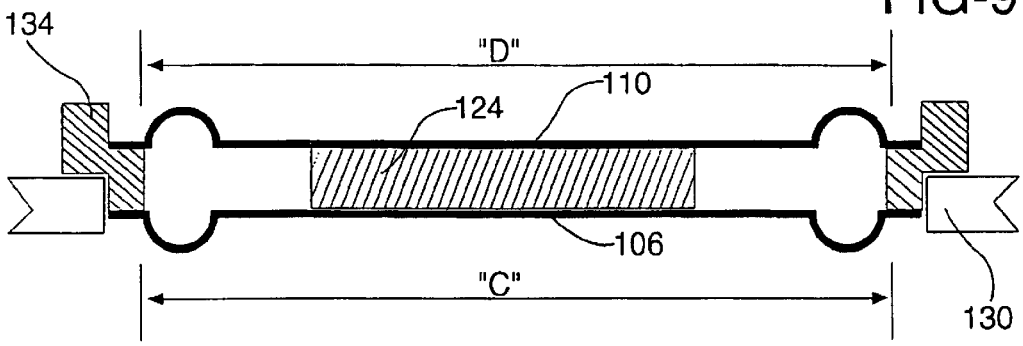
FIG. 9 shows a configuration according to the present invention fixed in a speaker wall.

A configuration according to the present invention has the additional advantage of eliminating the wobble problem by the use of a parallelogram-type parallel link arrangement where the two diaphragms 106, 110 each have their perimeters act as two ends of a fixed link of a parallelogram type linkage. A second set of fixed links are the corresponding inner and outer walls to which the outside perimeter of the surrounds 114, 118 are fixed. The moveable links connecting the two fixed links are the surrounds which extend between the perimeter of the central diaphragm 106, 110 and the inner perimeter of the outer ring for example, 134 in FIG. 9. Using this configuration will reduce any wobble by creating additional resistance to a wobbling effect due to the two surrounds being mounted in parallel at the end of what effectively amounts to an elastically extendible pivoting lever arm. Thus any configuration according to the invention for example as shown in FIG. 9, where a 45 degree sound wave coming into the central diaphragm would be resisted by both sets of surrounds such that predominately linear motion perpendicular to the face of the diaphragms would occur. The motion of the central diaphragm assembly while not completely limited to a linear back and forth motions is severely constrained to move easily only back and forth perpendicular to the diaphragms 106, 110 absent a strong transverse force vector. Similarly, the flat face of the diaphragm rigidly resists pressure pulses having force vectors which are parallel to its face, while it is very easily movable in a direction perpendicular to its face when impacted by sound pulses having force vectors with directional components perpendicular to the face of the diaphragm. In this way, an improved passive radiator can be constructed and used. While in the Figures shown, the ratio of the inner and outer diaphragm support openings are substantially equal, (i.e., they have a ratio of approximately 1), it is possible to construct passive radiators according to the invention where the ratio of the smaller diaphragm connection opening to the larger diaphragm connection opening is approximately 0.8 or greater (e.g., distance "C" on one side of the opening will be different than the distance "D" by a ratio of the smaller to the larger of 0.8).

The construction of the passive radiator is quite simple as shown in FIGS. 7, 8, 9, 10 and 11. The outside edge of the surrounds can be fixed directly to a sealed cavity or can be fixed to a surround support ring 134 which in turn is then fixed to a speaker enclosure wall 130. Some combination of elements to hold the outer ring and allow the center to move freely from its neutral position must be found.

An alternative configuration using a series of surrounds 142, 144 provides that the arches of 146, 148 such surround must extend in a single direction. This configuration while not optimum does provide the advantage over the prior art of eliminating or substantially eliminating the wobble problem referred to earlier. In a configuration as shown, the spring constants will be unequal and the non-linearity of the spring constant plot will be attenuated by the use of two surrounds whose spring constants add to exacerbate their distortion from linear.

Figure 12:
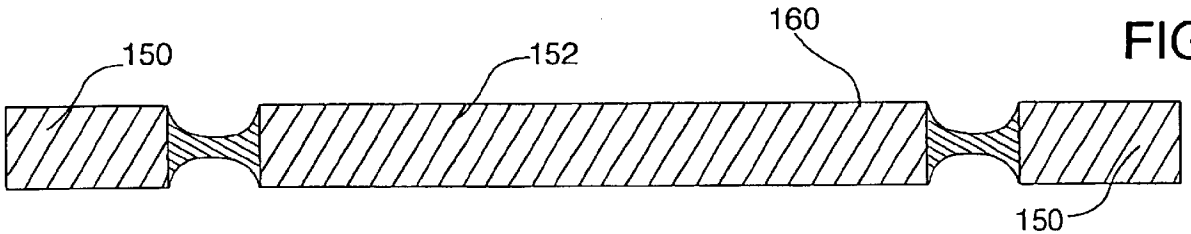
FIGS. 12, 13 and 14 show cross sectional views of several alternate embodiments according to the invention, where the wall of the speaker cabinet is used as the flat central core member of the passive radiator in a speaker system.

FIG. 12 shows an alternate embodiment according to the invention, a speaker cabinet wall 150, initially one piece, has circular slot routed into it thus separating a centerpiece 152 from the speaker cabinet wall 150. The round centerpiece 152 is centered in the opening of the cabinet wall and a wide contoured bead of filler material (e.g., silicon rubber) is run between the inside of the outer opening of the wall and the outside of the centerpiece 152. The cross sectional shape of the filler material is such that it retains an elastic character once cured. The cross section shown is commonly found in elastic seals between building joints where substantial movement is expected.

Figure 13:
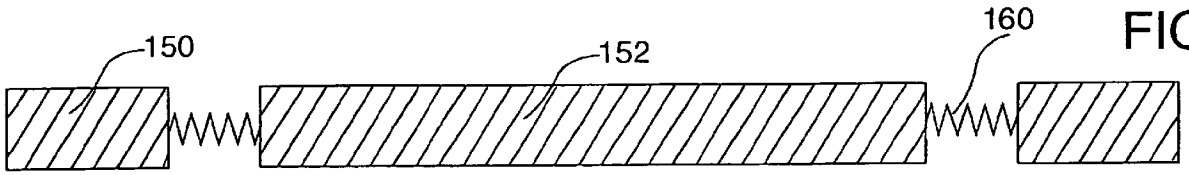

FIG. 13 pictures a spider type elastic member 160 having been placed between the centerpiece 152 and the speaker cabinet wall 150, as described for FIG. 12 above.

Figure 14:
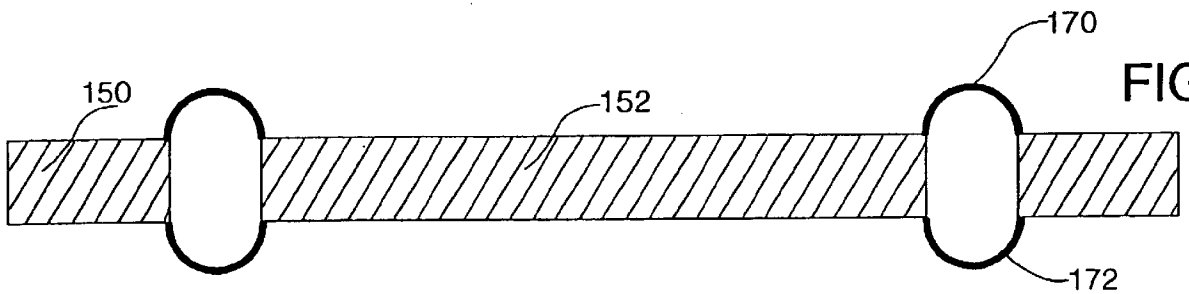

FIG. 14 pictures an alternate embodiment where a set of two surrounds 170, 172, provide the elastic connection between the speaker cabinet wall 150 and the centerpiece 152. While a round shape is preferred, the use of a less efficient shape is in accordance with the invention, for example a polygon or a compound curve shape may be used. A centerpiece thickness in excess of 0.25 inches is preferable to help maintain a linear movement and reduce or eliminate any wobble that may occur.

Figure 1:
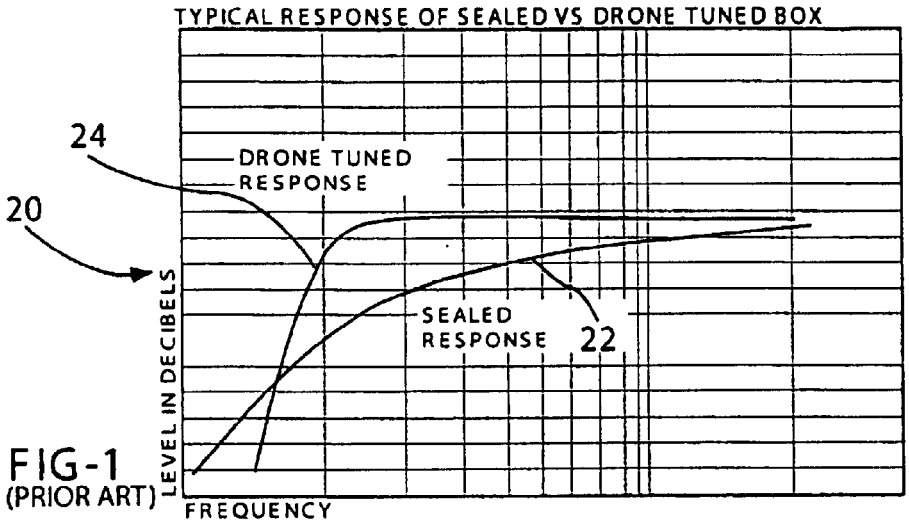
FIG-1 (PRIOR ART)
FIG. 1 is a plot of frequency response versus sound level in decibels showing the response of a sealed speaker box and a conventional droned tuned speaker box.
Figure 2:
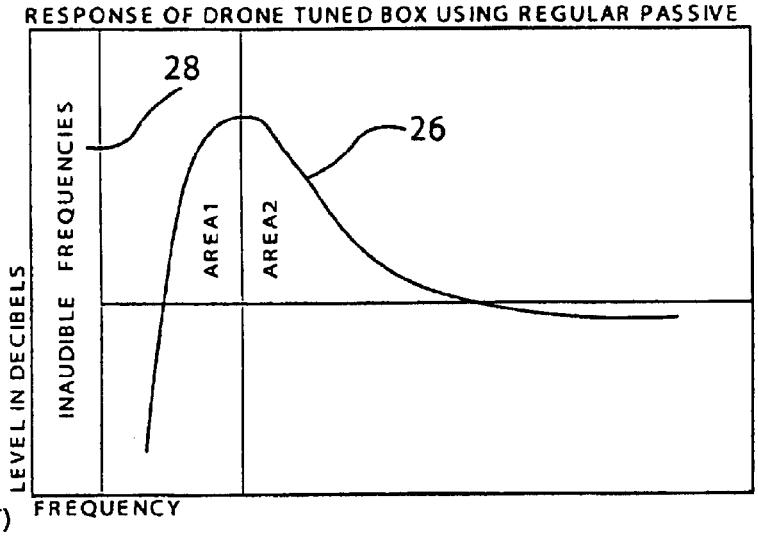
FIG-2 (PRIOR ART)
FIG. 2 is a frequency response graft showing the plot of the frequency response contribution from a passive radiator to the total tuned response in a speaker box system.
Figure 3:
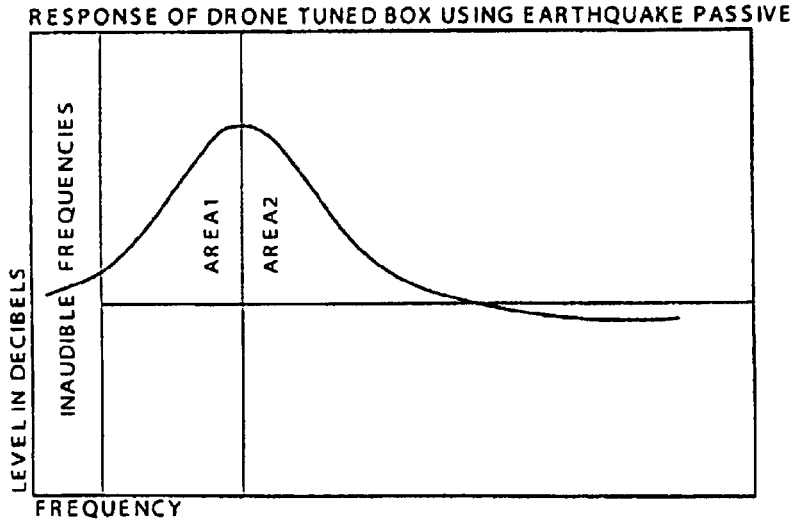
FIG. 3 is a frequency curve showing a plot of the frequency response using a device according to the present invention.

A review of the plot as shown in FIG. 3 shows that the frequency response of a tuned passive radiator according to the invention extends the usable frequency range from the low audible to the inaudible range of frequencies. All audible frequencies can be heard and the inaudible frequencies for example, an earth shake or pounding can be generated by such speakers so that the user can "feel" the vibration as the user's surroundings susceptible to such low frequency waves start to vibrate. The use of such speaker enhancing device is very attractive to sophisticated users as well as the general public in viewing many action movies that feature such low frequency sounds.

An aspect of the present invention further enhances the sound performance. The closure of spaces between opposing surround rolls can cause a high pressure secondary cabinet that slows down the response. A pressure relief system is provided to allow the air trapped between two diaphragms to have the same pressure as that in the speaker box (or alternately outside the speaker box) via port holes that are large enough to keep the air speed through these holes under 1% of the speed of sound with a value of about 12 ft/second. Since these numbers are worse at the passive resonance frequency, this calculation can be optimized for the maximum excursion calculation. The pressure relief port can be implemented best through holes in the inner surround that leak air directly into the speaker box.

Figure 15:
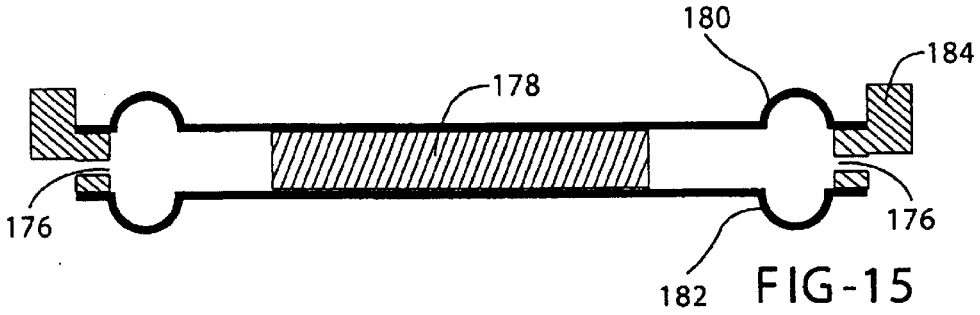
FIGS. 15, 16 and 17 show a schematic cross sectional configuration where the embodiment of FIG. 9 has been modified and configured with features which enhance in several different ways the passive speaker design.
Figure 16:
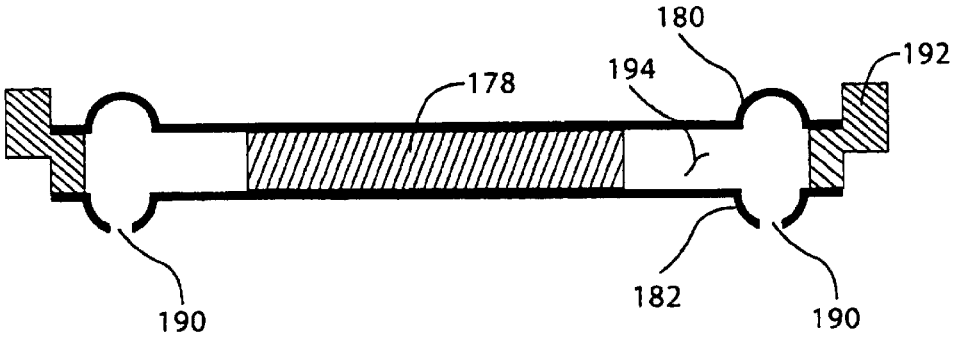
Figure 17:
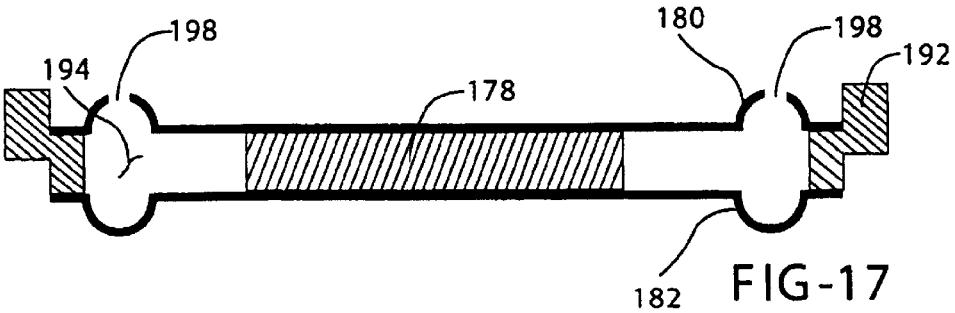
Figure 18:
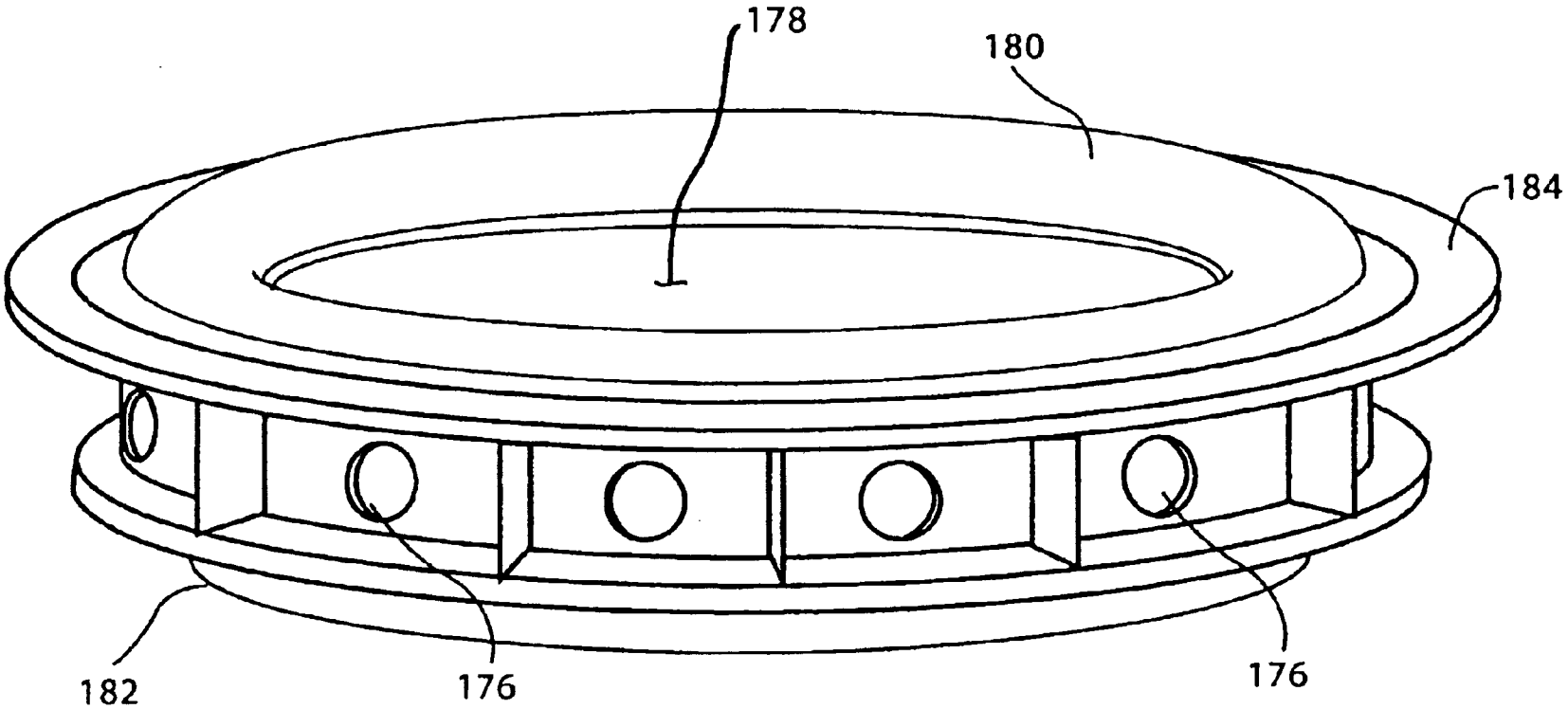
FIG. 18 shows a perspective view of a passive speaker according to the invention incorporating frame vent holes as one aspect of the invention.

FIGS. 15, 16 and 17 show several ways that an air vent (pressure relief system) according to the invention can be implemented. FIG. 15 shows in cross section vent holes 176 disposed to provide one or more passages from the air space between the center mass 178, the outer elastic member (surround) 180, the inner elastic member (surround) 182, and the outside frame 184, which can form a pressurizable chamber, through the frame 184. These same holes 176 are shown in the perspective view of FIG. 18 and again in the cross sectional perspective view of FIG. 19. In the schematic views in particular, it appears that the holes 176, in use, are situated to be nearly sealed against the surrounding wall hole opening of the speaker box in which the passive radiator might be mounted. To operate without noise and undue damping there must be a space between the hole of the speaker box in which such a configuration is mounted and the perimeter of the radiator frame 184 facing it, so that air can pass freely at speeds below 2% of the speed of sound.

FIG. 16 shows a schematic cross sectional view of an alternate configuration for maintaining parallelism as the center mass moves back and forth due to speaker box pressures while still providing for improved response and large travel due to a pressure extremes. A series of holes (or slits) 190 are disposed approximately equally spaced around the annular ring of the inside surround 182. The holes 190 in this configuration are open to the inside of a speaker box and act as a vent to prevent the build up of pressure in the surround contained air space 194. In the this configuration an outside frame flange 192 is solid.

Figure 20:
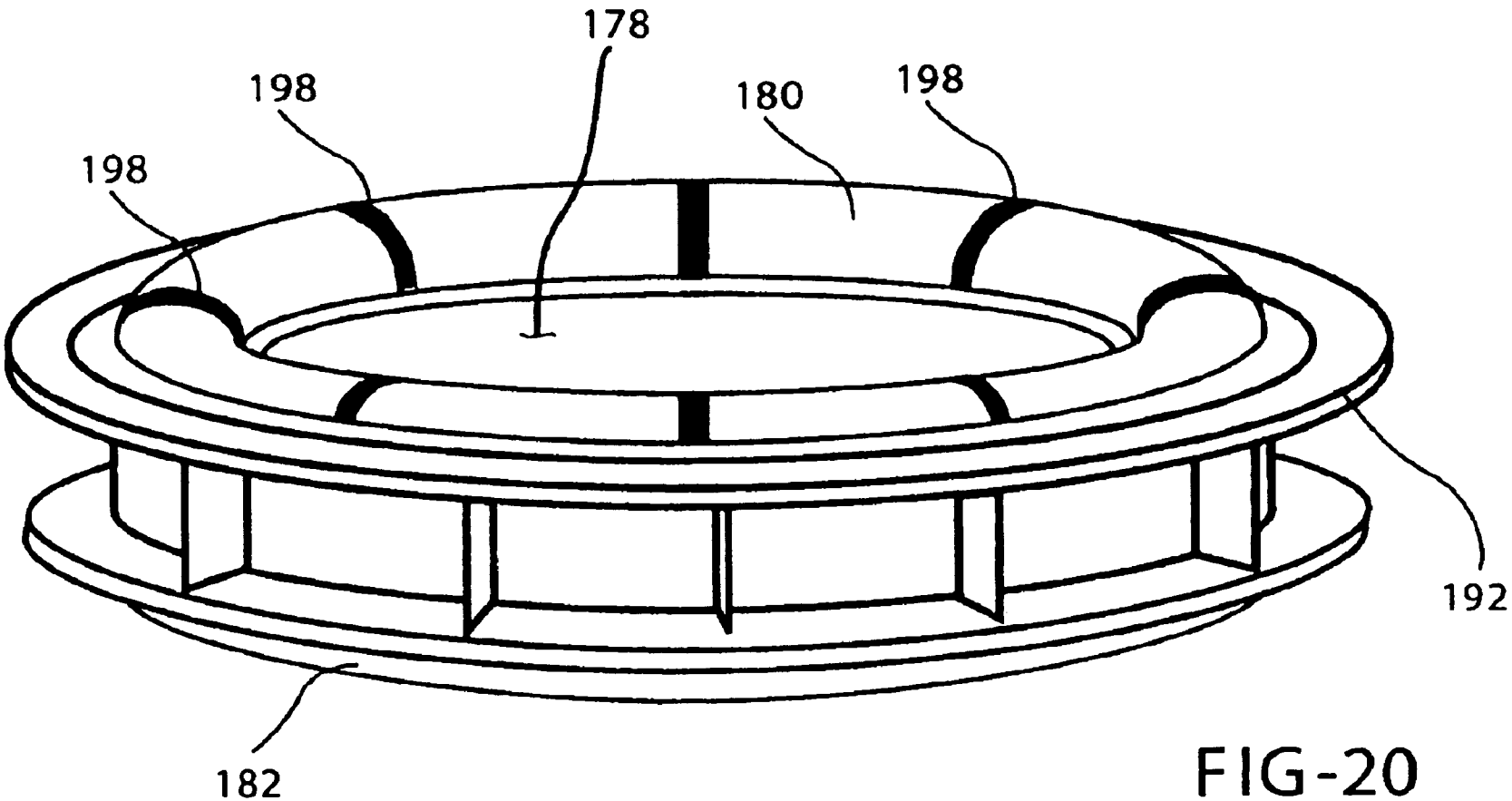
FIG. 20 shows a perspective view of a passive speaker according to the invention incorporating surround openings (slits) as vent holes as one aspect of the invention.
Figure 21:
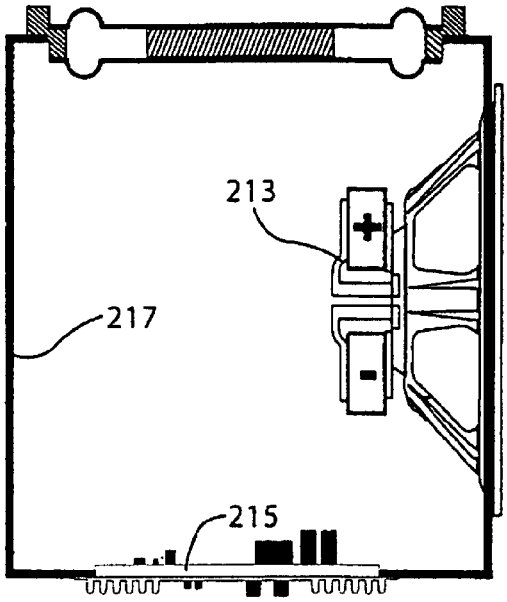
FIG. 21 shows a schematic cross sectional view of a speaker box utilizing a passive speaker design according the invention.
Figure 22:
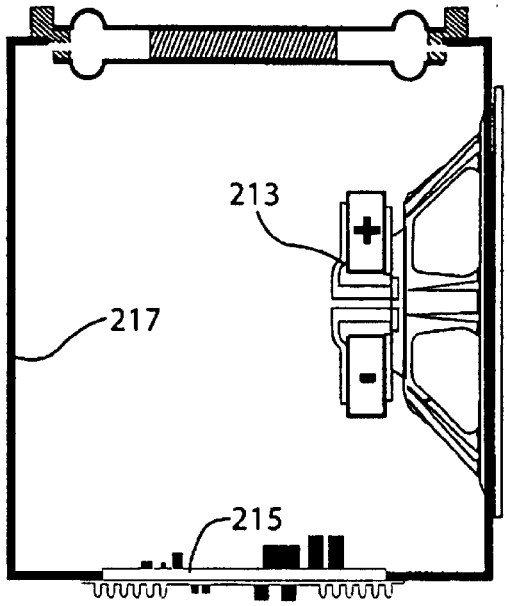
FIG. 22 shows a schematic cross sectional view of a speaker box utilizing a passive speaker with through the frame vent holes in a design according the invention.
Figure 23:
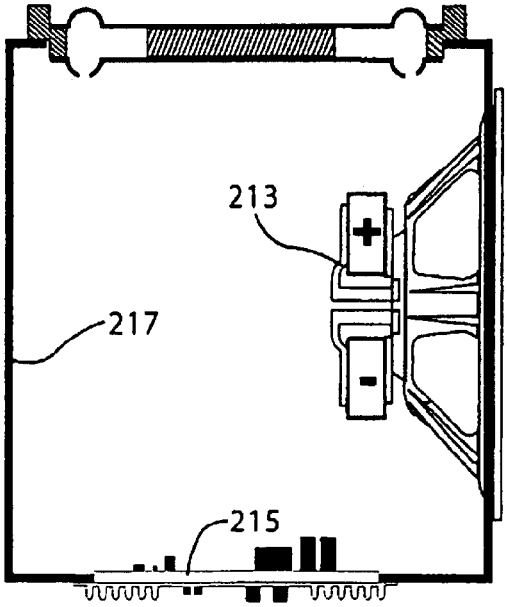
FIG. 23 shows a schematic cross sectional view of a speaker box utilizing a passive speaker with through the surround vent holes communicating with the inside of the speaker box enclosure in a design according the invention.
Figure 24:
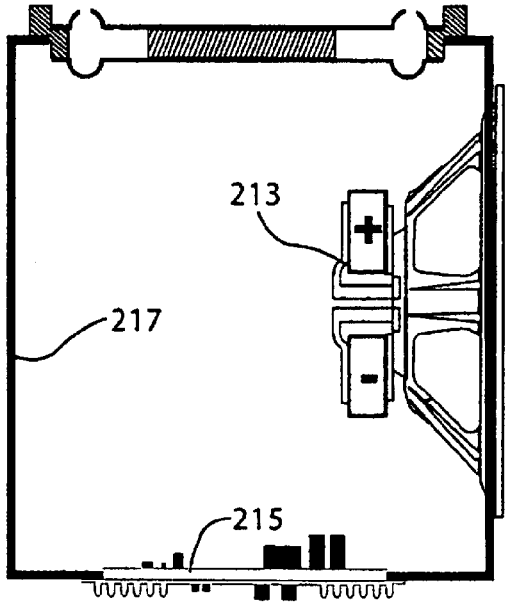
FIG. 24 shows a schematic cross sectional view of a speaker box utilizing a passive speaker with through the surround vent holes communicating with the outside of the speaker box enclosure in a design according the invention.

FIG. 17 shows a schematic cross sectional view similar to the configuration shown in FIG. 16. In this embodiment1here are a series of holes (or slits) 198 which are disposed approximately equally around the annular ring of the outside surround 180. The configuration of these holes 198 is also shown in FIG. 20, which shows a perspective view of this configuration. The holes 198 in this configuration are open to the outside of a speaker box and act as a vent to prevent the buildup of pressure in the surround contained air space 198.

Figure 19:
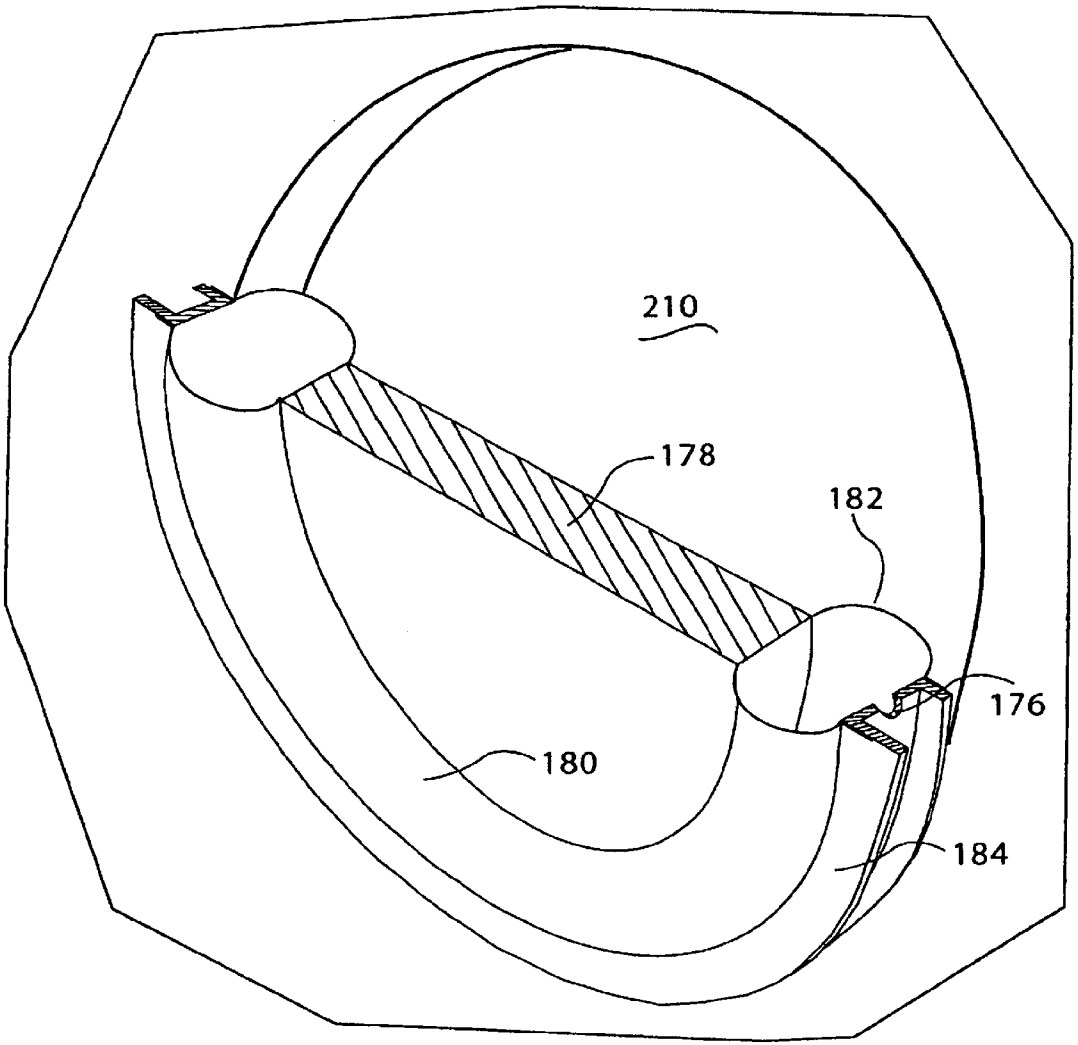
FIG. 19 shows a cross sectional perspective view of a frame side vent holed configuration as shown in FIG. 18.

FIG. 19 shows the passive radiator relationship to its mounting to a speaker box opening 210. In this configuration the outside frame 184 has two flanges, one smaller in diameter (which fits into the speaker box opening 210) and a second one that is larger in diameter that seals to the surface around the speaker box opening.

FIGS. 21, 22, 23 and 24 show arrangements of a speaker (high pressure box) box containing a driver (speaker) 213 and an amplifier frame with amplifier circuitry 215 fixed to the speaker box 217 (in these instances the frame is sealed to an opening of said speaker box with heat sink elements of the amplifier outside the box). Each of these speaker boxes includes an opening for receiving a passive radiator according to the invention. Passive radiators as shown and described in FIGS. 9, 15, 16 and 17 are shown positioned in the passive radiator opening of the speaker box as pictured in FIGS. 21, 22, 23 and 24, respectively.

Progressive Surround Roll Radiator Construction

An aspect of the present invention that utilizes low profile large stroke passive radiators includes the use of a progressive roll system that further enhances the performance of passive radiator design.

Low frequency instruments emanate sound waves via vibration of diaphragms. These diaphragms oscillate at a low frequency. The oscillations have maximum amplitude in the center of the diaphragm with a proportionally reduced oscillation across the diaphragm with no oscillatory motion at the diaphragm frame. The dynamic oscillatory activity associated with a bass drum is useful in illustrating the dynamic relationship between the oscillating diaphragm and the emanating sound wave.

When a drummer strikes the center of the bass drum, the striking force bends the diaphragm inward such that the diaphragm shape is no longer flat, but is deformed in an approximation of a cone or sphere. The pressure inside the drum increases and is transferred to the other side of the drum, and results in an outward movement of the diaphragm. The tension and the phase angle of the sound wave as they bounce back and forth allow the signal to decay in a harmonic fashion. The decay time is directly related to the diaphragm diameter, tension and the distance between the two diaphragms at any fixed frequency. Utilizing the apparatus and methods according the invention provides that opportunity to approach a bass drum sound when using relatively smaller 12" and 15" speakers. To approach the desired condition the passive radiator is matched with the speaker has to be tuned low enough and has to move out axially to produce the same air movement, i.e., SPL at any given frequency is strictly related to the quantity of air moved at that frequency. The quality of sound must also be maintained. The quality of sound is measured by the group delay. A group delay is the time versus frequency curve that describe the response time delay at any given frequency. A 20 ms delay at 20 Hz is said to be audible distortion. Group delay is directly proportional to the diaphragm excursion. A long excursion creates long group delays.

Figure 25:
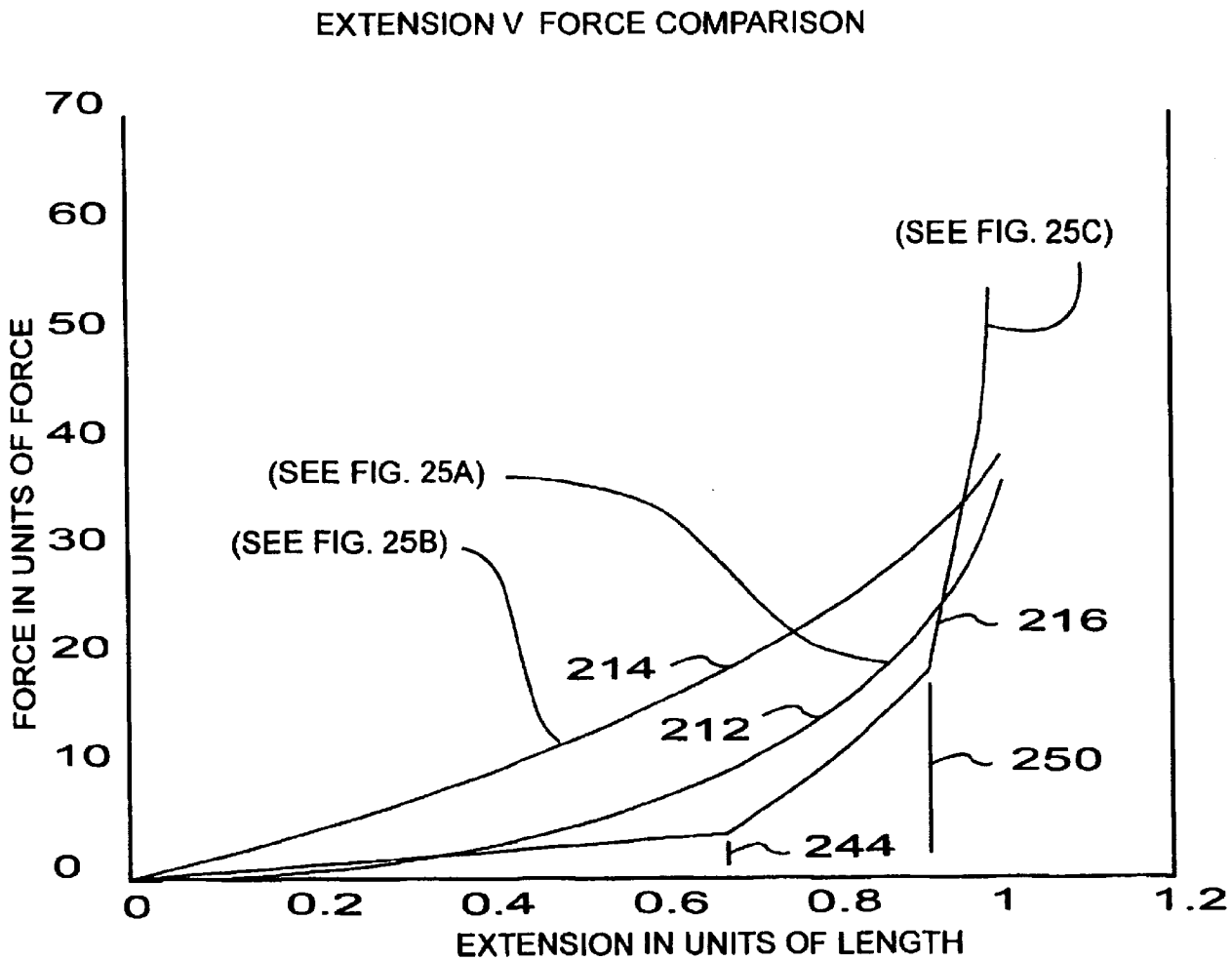
FIG. 25 shows plots of surround extension versus force for several configurations (as shown in FIGS. 25A, 25B and 25C) of large displacement passive radiators to show a comparison of generalized behavior when the progressive roll embodiment of the present design is compared with several alternatives.
Figure 25B:
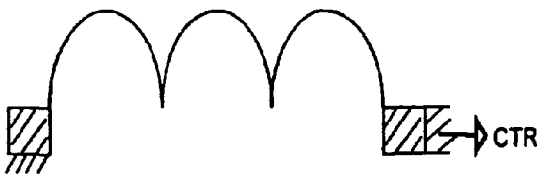
(Prior Art) FIG-25B
FIG. 25B shows across sectional view of one elastic membrane of a set of two which support a mass from a frame for a low profile passive speaker, the design includes three surround rolls having substantially equal roll diameter.
Figure 25A:
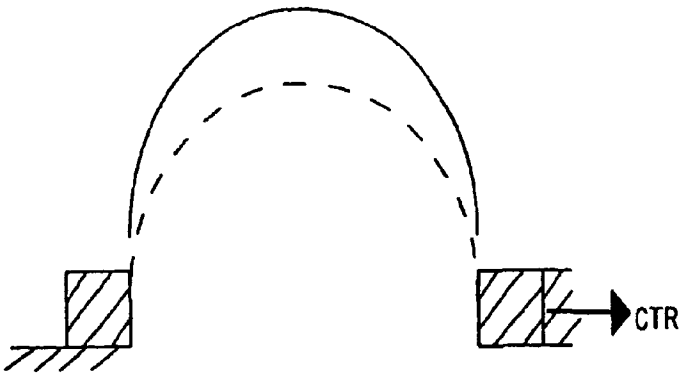
(Prior Art) FIG-25A
FIG. 25A shows a cross sectional view of one elastic membrane of a set of two which support a mass from a frame for a passive speaker, the design includes two examples of using one large roll to span a large gap to provide a large stroke for the vibrating mass.

One example of a surround structure used in a speaker is to used a single large, surround, a cross section of which is pictured in FIG. 25A. The single surround provides a large axial stroke and an even larger stroke if a an elliptical cross section (as shown by the solid line) as opposed to the circular cross section (as shown by the dashed line) is used. While this configuration has a good potential for large axial movements, the large roll diameter allows side to side instability at even small increments of axial excursion. A plot of relative excursion versus relative force for an approximation of an elliptical surround configuration is shown as curve 212 as pictured in FIG. 25. The restoring force is relatively small at small axial displacements (extensions) and rises rapidly as the extension increases.

Figure 4:
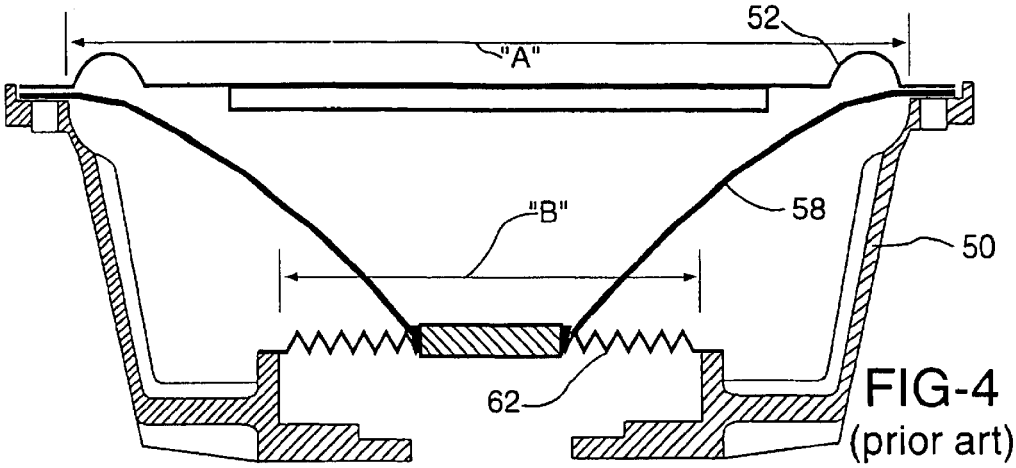
FIG-4 (prior art)
FIG. 4 is across sectional view of the prior art passive radiator supporting masses at both the base of the cone and on a diaphragm spanning the large opening of the cone at the base of the speaker.
Figure 5:
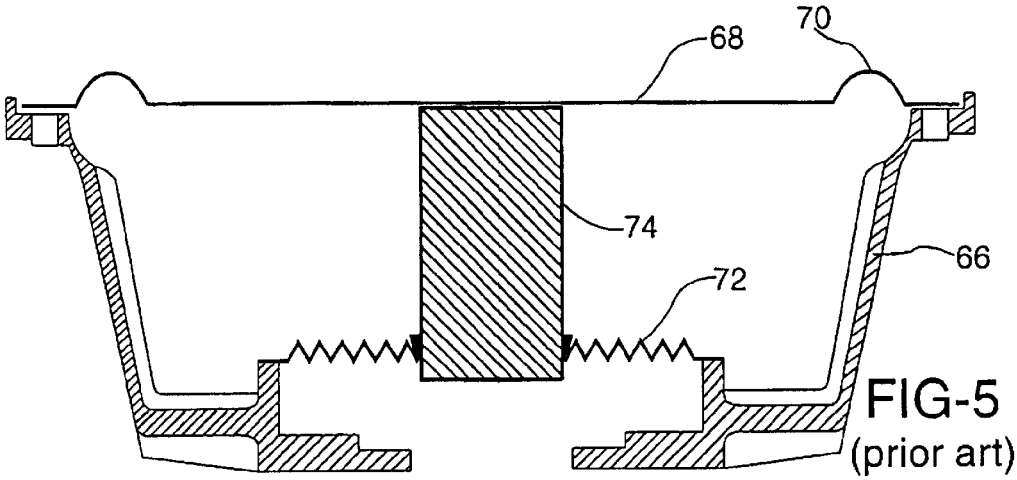
FIG-5 (prior art)
FIG. 5 is a cross-sectional view of a prior art passive radiator showing a moveable diaphragm connected to a speaker surround at the mouth of the speaker basket to a speaker spider at the back of the speaker basket.
Figure 6:
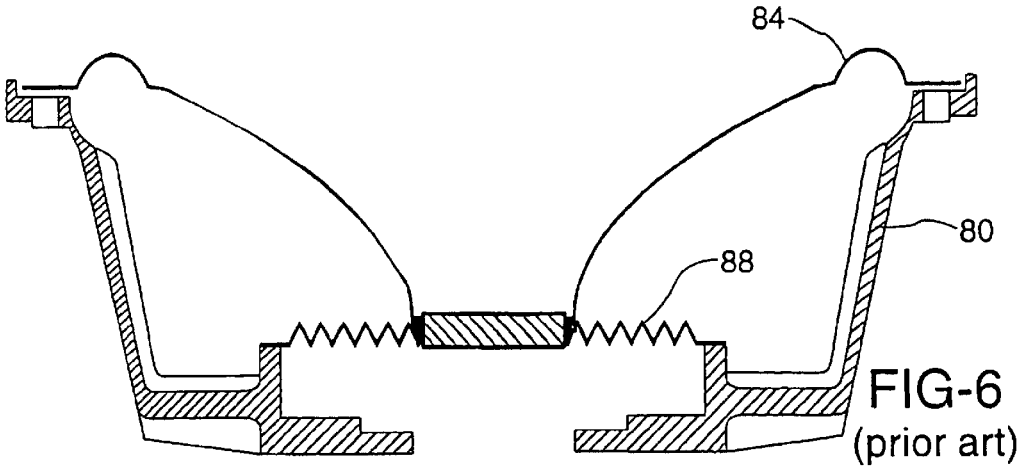
FIG-6 (prior art)
FIG. 6 shows a cross-section of a prior an passive radiator showing a speaker cone with a tuning mask at its base connected to the spider to the speaker basket at its narrow end connected through a surround to its wide end of the speaker basket.

A second example of a surround structure is the use of what are known as an "m" surround (two or more side by side surrounds). FIG. 25B shows such a structure where three smaller roll diameter surrounds are joined in a concentric circle pattern with the intent to achieve a large excursion—like the one shown for the single surround of FIG. 25A—with a lower profile. A plot of relative excursion versus relative force for an approximation of the three side by side surround arrangement is shown by the plot 214 shown in FIG. 4. The restoring force at low excursion (extension) dimensions is greater than that for a single elliptical surround as shown in FIG. 25A.

Figures 26A, 26B, 27A, 27B:
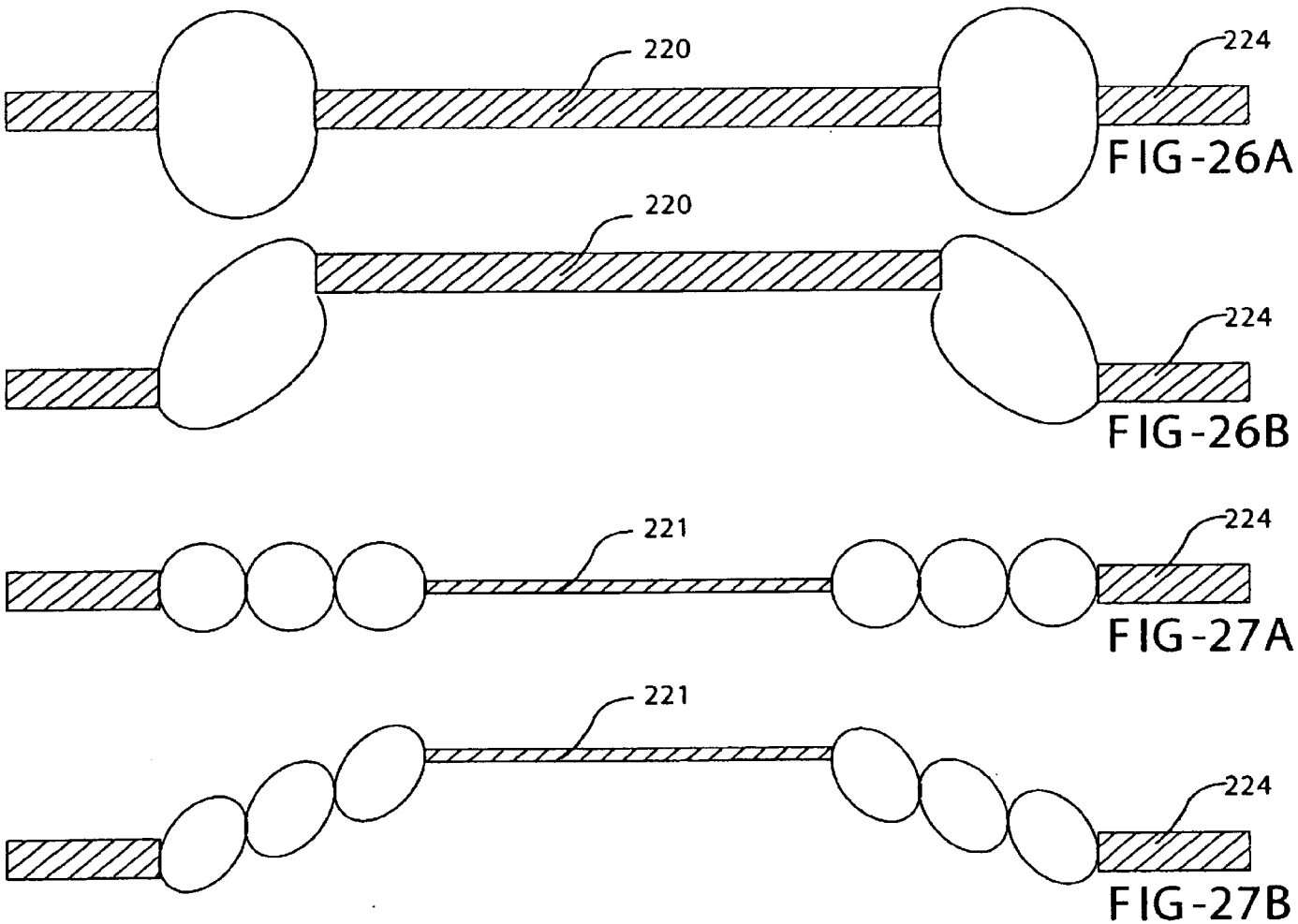
FIGS. 26A and 26B show cross sectional schematic views of the single surround large gap arrangement as shown in FIG. 25A, the relaxed state is shown in FIG. 26A and a nearly-fully extended state is shown in FIG. 26B.
FIGS. 27A and 27B show cross sectional schematic views of the three equally sized roll diameter surround arrangement as shown in FIG. 25B, the relaxed state is shown in FIG. 27A and a nearly fully extended state is shown in FIG. 27B.

A set of cross sectional views of a passive speaker arrangement using the single large surround and the three small surrounds (of FIGS. 25A and 25B) in a relaxed state is shown in FIGS. 26A and 27A, respectively, and in their fully extended state in FIGS. 26B and 27B, respectively. What is noteworthy about reviewing these passive radiator arrangements is that while their relative force versus extension curves are relatively straightforward (though nonlinear) and similar, the excursion in the axial direction of motion is distributed substantially uniformly over the whole span of the gap between the centerpiece (220 or 221) and the outer frame 224. This uniform distribution of the strain (extension or excursion) correlates to a lateral (side to side) instability (wobble) of the centerpieces even at small excursions associated with small sound pressure levels. And any instability introduced at small excursions is amplified as the magnitude of the excursion increases.

To optimize an apparatus according to the present invention large qualities of air must be moved, but using the shortest most even diaphragm possible, like a bass drum. The diaphragm movement must decay uniformly at the side, i.e., as the diaphragm approaches the stationary frame. The movements must be axial and not side to side as such movements will cause a wobble that produces audible distortion.

Figure 25C:
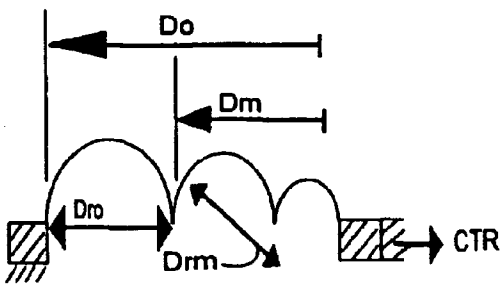
FIG. 25C shows a cross sectional view of one elastic membrane of a set of two which support a mass from a frame for a low profile passive speaker, the design includes three surround rolls utilizing progressively smaller surround roll diameters as the elastic membrane moves from the perimeter frame to the center mass.
Figures 28, 28A, 28B, 28C:
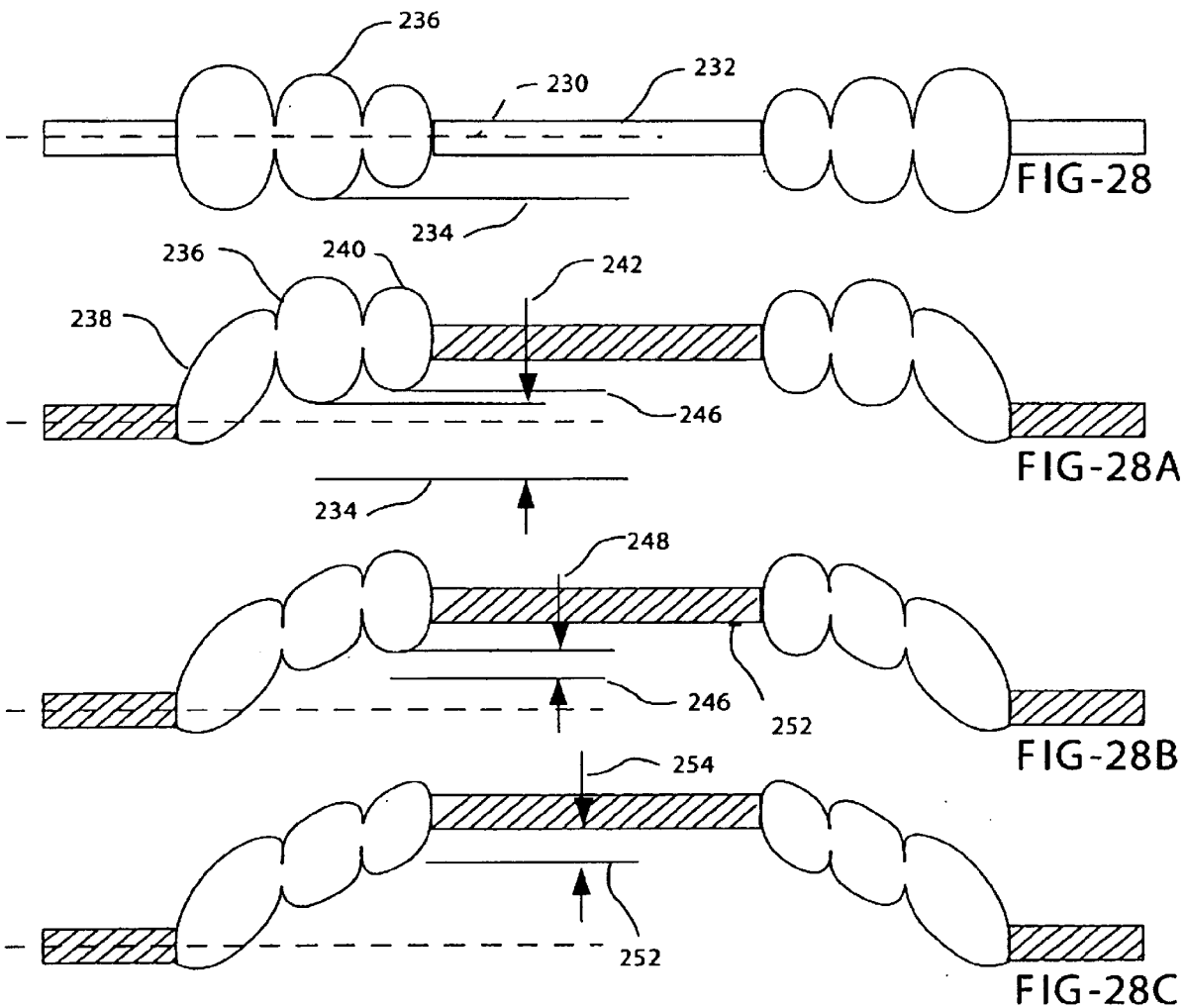
FIGS. 28, 28A, 28B and 28C show cross sectional schematic views of the three progressively sized roll diameter surround arrangements as shown in FIG. 25C and according to the invention, the relaxed state is shown in FIG. 28 and a nearly fully extended state is shown in FIG. 28C, a state where substantially only the outer surround roll is extended is shown in FIG. 28A, and a state where the outer surround roll and middle surround roll are substantially fully extended is shown in FIG. 28B.

An embodiment according to the invention which overcomes the drawbacks of the previously discussed arrangements, is to use a progressive roll diameter configuration, for example a cross section of which is shown in FIG. 25C. In this arrangement a set of three surrounds are provided, the outer surround being the largest, with surrounds internal to the outer one being progressively smaller. This arrangement provides a non uniform position specific extension characteristic, an approximation of which is shown by the curve 216 in FIG. 25. An understanding of the localized position based extension of the progressive surround arrangement can be understood by correlating the plot of the curve 216 in FIG. 25 with the relative movement of the centerpiece and surround portions as shown in FIGS. 28, 28A, 28B and 28C. A relaxed unextended condition of a passive radiator is shown in FIG. 28, where dashed line 230 correlates to the centerline of the frame and centerpiece 232 in an at rest condition and where line 234 provides a relative position reference for the position of the middle surround 236. In FIG. 25 this condition is represented by the origin (position 0,0). When a first level excursion (extension) takes place as is shown in FIG. 28A, the interrelationship of the overall stiffnesses of the three adjacent surrounds causes the perimeter surround 238 to be stretched to its travel limit at a first correlative rate, while the middle surround 236 and the inner surround 240, are stretched very little and almost not at all, respectively. The first correlative rate, might be considered to be an approximation of a spring constant which correlates to the movement of the centerpiece 232 from its at rest position to be displaced a distance 242 which shows that the movement of the centerpiece is due to the extension of the outer surround 238. The displacement of the centerpiece to this first level correlates to the portion of the curve 216 that goes from the origin to a corner of the curve identified adjacent a vertical reference line 244 on FIG. 25. If the total available travel of the centerpiece is identified as being 100% which correlates to 1.0 in this example, then it can be seen from FIG. 25 that the relative travel due to extension of primarily the outer surround exceeds 60% of the total available travel. Thus all small excursions and even moderately sized excursions of the centerpiece occur at the outer perimeter of the structure in the outer surround thus providing a localized position based extension. The distance 242 shown in FIG. 28A correlates approximately to the curve position associated with the reference line 244.

In FIG. 28A, reference line 246 correlates to the position of the inner surround 240 at the first level extension shown in FIG. 28A.

FIG. 28B shows a second level extension of the centerpiece 232 of the passive radiator. In this condition, the outer surround 238 which had formerly been stretched to the limit of its travel, stretches no more. The additional travel of the centerpiece, through a distance 248, occurs primarily by stretching of the middle surround 236, with very little stretching of the stiff inner surround 240. The increased force needed to stretch the middle surround (stiffness) causes the curve 216 relating to the movement of the centerpiece to turn a corner (at 244) and move at an increased rate upward to a curve position correlating to the reference line 250 on FIG. 25. At this position, the middle surround 236 has reached the limit of its travel. A reference line 252 corresponding to the vertical position of the bottom of the centerpiece 232 at this second level position is identified in FIG. 28B.

FIG. 28C shows the fully extended third level position of the centerpiece 232 showing the vertical travel distance over the second level position as shown in FIG. 28B. To reach this position, since both the outer 238 and middle 236 surrounds had reached the limits of their travel only the inner surround is subject to stretching. This stretching occurs over the distance 254, which correlates to the portion of the curve 216 to the right of the reference line 250. Curve 216 again turns a corner (at 250) and requires a markedly increased rate of force versus extension to achieve full travel. The result being that while the general overall characteristics of the progressive roll configuration exhibits a similar overall appearance, the actual performance due to the localized position based extension substantially reduces the chance that wobble (as sound distortion) will be heard at low sound pressure levels without unduly limiting the ability of the passive resonator to resonate at relatively high sound pressure levels without audible distortion which results in improved sound quality.

As shown in the FIG. 28 series, vent opening between adjacent surround compartments allows for pressure equalization and/or venting. Several other configurations will be discussed below.

The sizing of the surrounds closest to the perimeter compared with the surrounds positioned closer to the center of the vibrating element depends on two important considerations:

1. Linear stiffness where by the closest to the perimeter (next to the frame) surround will approach maximum excursion just as the range of excursion for the next adjacent surround begins a larger relative motion. This is necessary to produce a distortion free response. If this is not respected a harmonic distortion will overwhelm the fundamental signal and will create a complex signal out of a single tone.
2. The outer roll diameter, whereby the piston diameters relates to the amount of movement for a particular piston and roll diameter. Also the second (inside the outer) roll diameter and the second piston diameter are related in a similar way. Furthermore the outer roll diameter and the inner roll diameter are related to each other in a proportional way such that the outer roll is larger than the inner one following the arc of sphere or a cone (e .g., the inner is no greater than 80% of the diameter of the immediately adjacent outer roll diameter). Once the outer diaphragm diameter (Do—diameter outer) is selected (see FIG. 25C) and a maximum excursion distance associated with the outer piston (the diameter to the outside of the selected surround) is selected and the configuration of the progressive roil arrangement is set. Since the maximum axis travel equates to approximately 70% of the corresponding roll diameter (dro—diameter roll outer) a ratio of (Do/dro) the roll diameter is set and the distance to the next diaphragm inside the outer one is set, approximately correlating to Do minus dro. Using the three surround example, the middle surround has a piston diameter (Dm—diameter middle) and a corresponding roll diameter (drm diameter roll middle) such that the ratio (Do/dm)=(Dm/drm) holds true as surrounds progressively get smaller toward the center. These ratios of geometric quantities in practice are dependent on material properties and transitional variations and thus are approximately equal rather than being exactly so. There will be an optimum value for the next roll diameter based on the air quantity moved and speed (i.e., surround stiffness).

Figure 29:
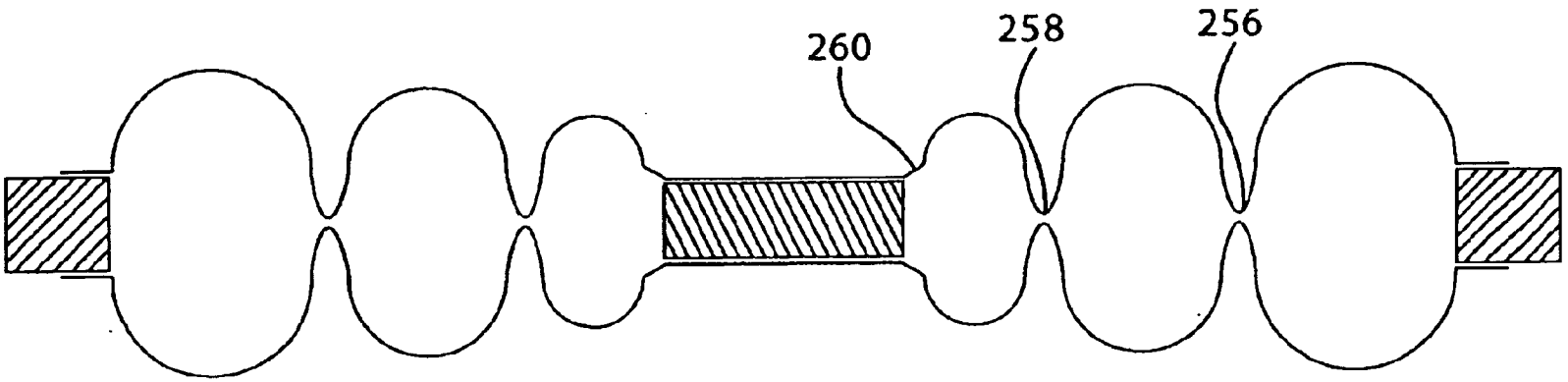
FIG. 29 shows a cross sectional schematic view according to the invention where three progressively sized surrounds contact each other at their saddles.

FIG. 29 shows a schematic cross sectional view of an embodiment of a progressive passive roll according to the invention where surrounds symmetrically mounted in opposing directions are connected by a series of smooth release transitions 256, 258, 260 to avoid material concentration and the elongation discontinuities associated with stresses and strains through such material concentrations.

Figure 30:
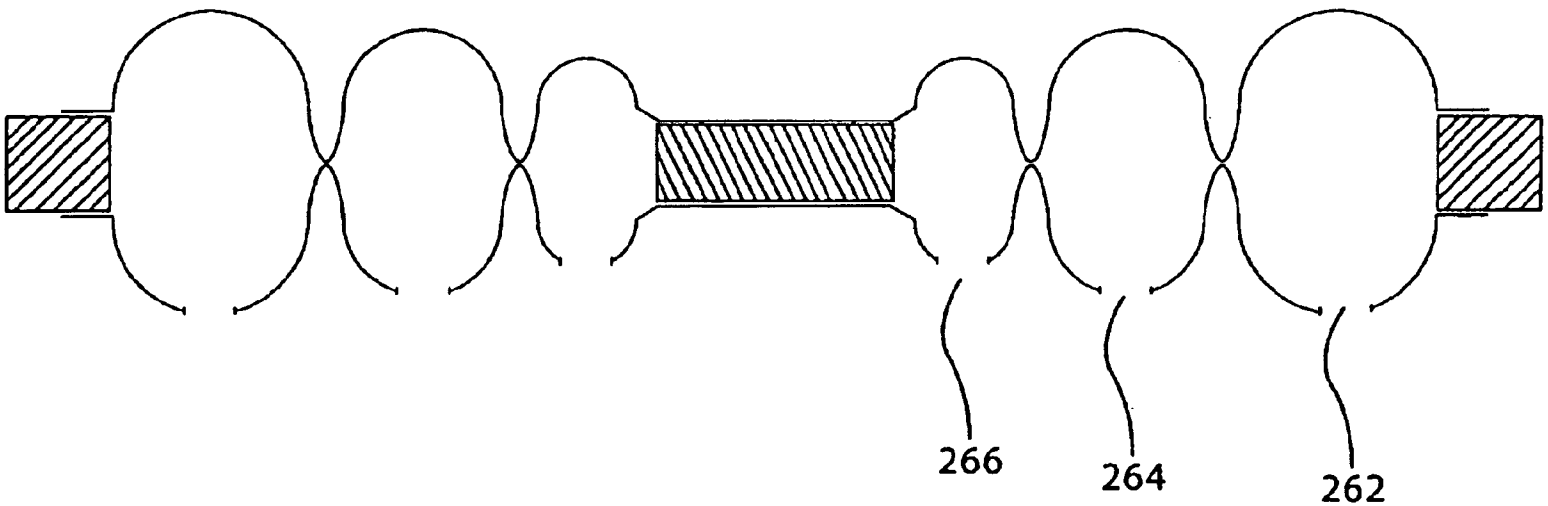
FIG. 30 shows a view of FIG. 29 with the addition of vent features for a device according to the invention.

During long strokes, the air trapped between the diaphragms can have a high pressure secondary cabinet that slows down the response. To eliminate this problem, air ventilation holes are made in the inside diaphragm (similar to that described above). The ventilation holes must have enough window area to allow air to pass at a speed of no more than 12 ft/sec (approximately 1% of the speed of sound). These holes must be symmetrical so that they do not pose a bias to the surrounds. FIG. 30 shows the configuration as shown in FIG. 29 modified to have vent openings 262, 264,266 through a face of the several surrounds, similar to that described above for the single is surround arrangement (e.g., FIG. 20).

Figure 31:
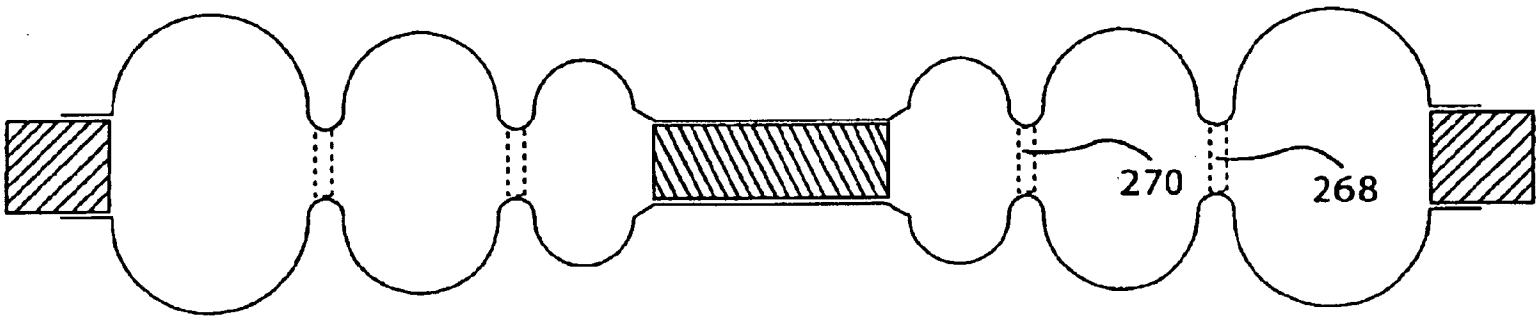
FIG. 31 shows a cross sectional schematic view according to the invention where three progressively sized surrounds are separated from each other at their saddles by spacers which maintain the distance between saddles.

FIG. 31 shows a schematic cross sectional diagram of a progressive roll arrangement, as previously described, where the centerpiece and frame vertical thickness are greater to reduce the chance of sideways motion and the related distortion. To prevent collapse (buckling) of the surround elements, a series of vertical spacers 268, 270, comprising vertical cylinders mating the valley bottoms between surround roll peaks together are provided. These spacers 268,270 can be a thin Mylar sheet or other comparable material whose effect is only to keep the corresponding connections on the upper and lower surrounds at equidistant to one another. In general it is preferred to have the spacer be so lightweight that the oscillatory reaction of the surrounds is unchanged from what they would be without the spacer, except that our of phase and collapse conditions are avoided.

Figure 32:
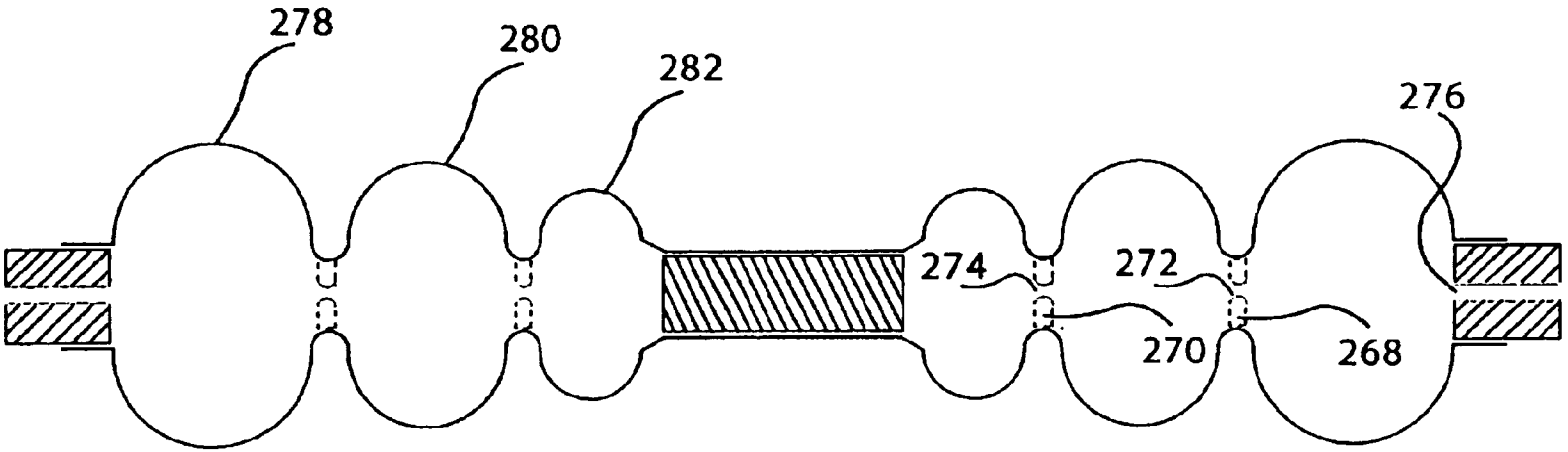
FIG. 32 shows a view of FIG. 31 with the addition of vent features for a device according to the invention.

FIG. 32 pro vides a vented configuration of the embodiment as shown in FIG. 31. The vents are holes 272, 274 through the wall of the spacers 268, 270 with a set of perimeter flange holes 276 providing surface area to allow air movement without generating audible notice of the movement.

Figure 33:
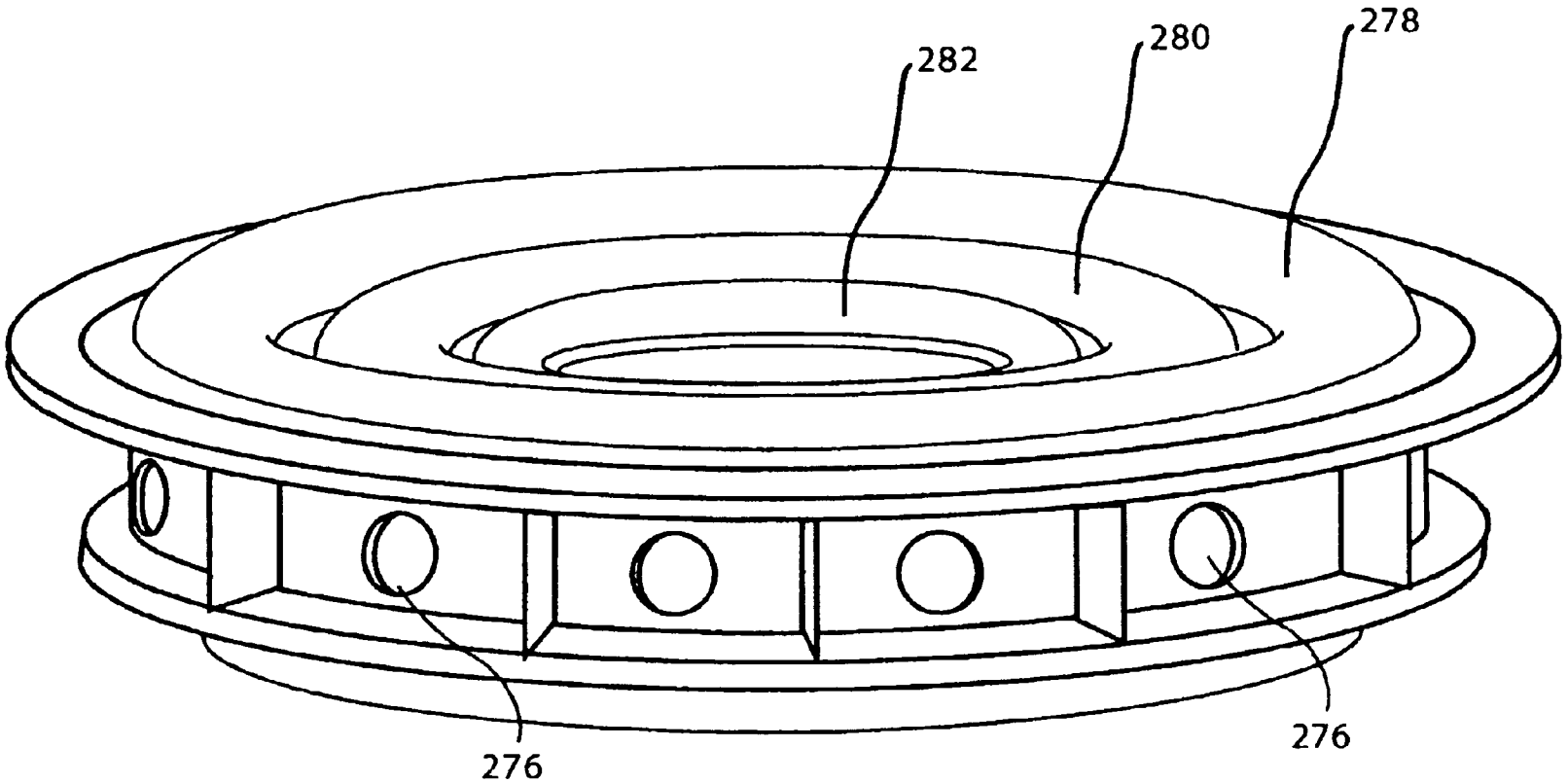
FIG. 33 shows a perspective view of a passive radiator incorporating three progressively sized surrounds as pictured in cross section in earlier Figures.

FIG. 33 presents a physical realization of the embodiment of FIG. 32. The perimeter flange holes 276 are shown distributed around the perimeter flange and the progressive surround roll diameters 278, 280,282, correlating to these structures in FIG. 32 are illustrated.

Tube Arrangement

Figure 34:
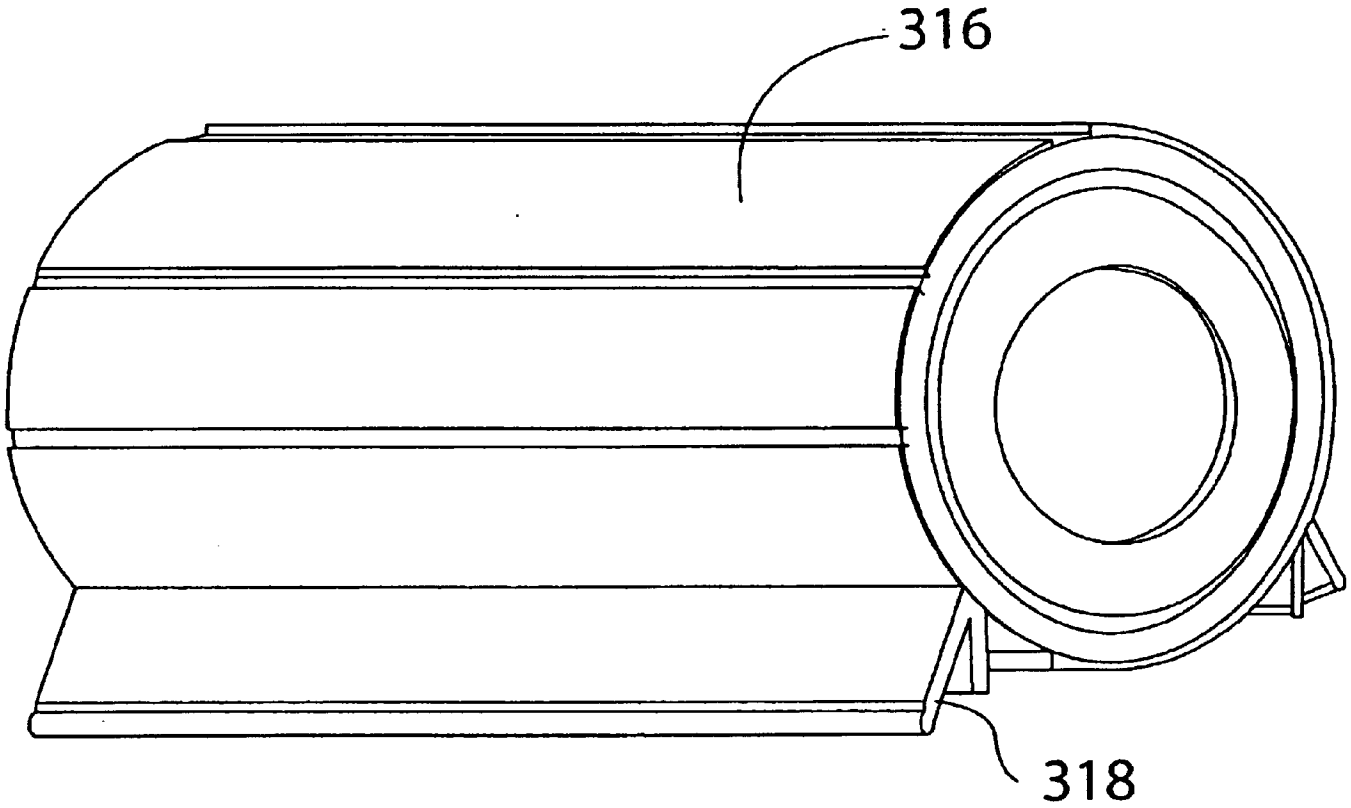
FIG. 34 a perspective view of a sound transducer system (speaker system) contained in a tube enclosure.
Figure 35:
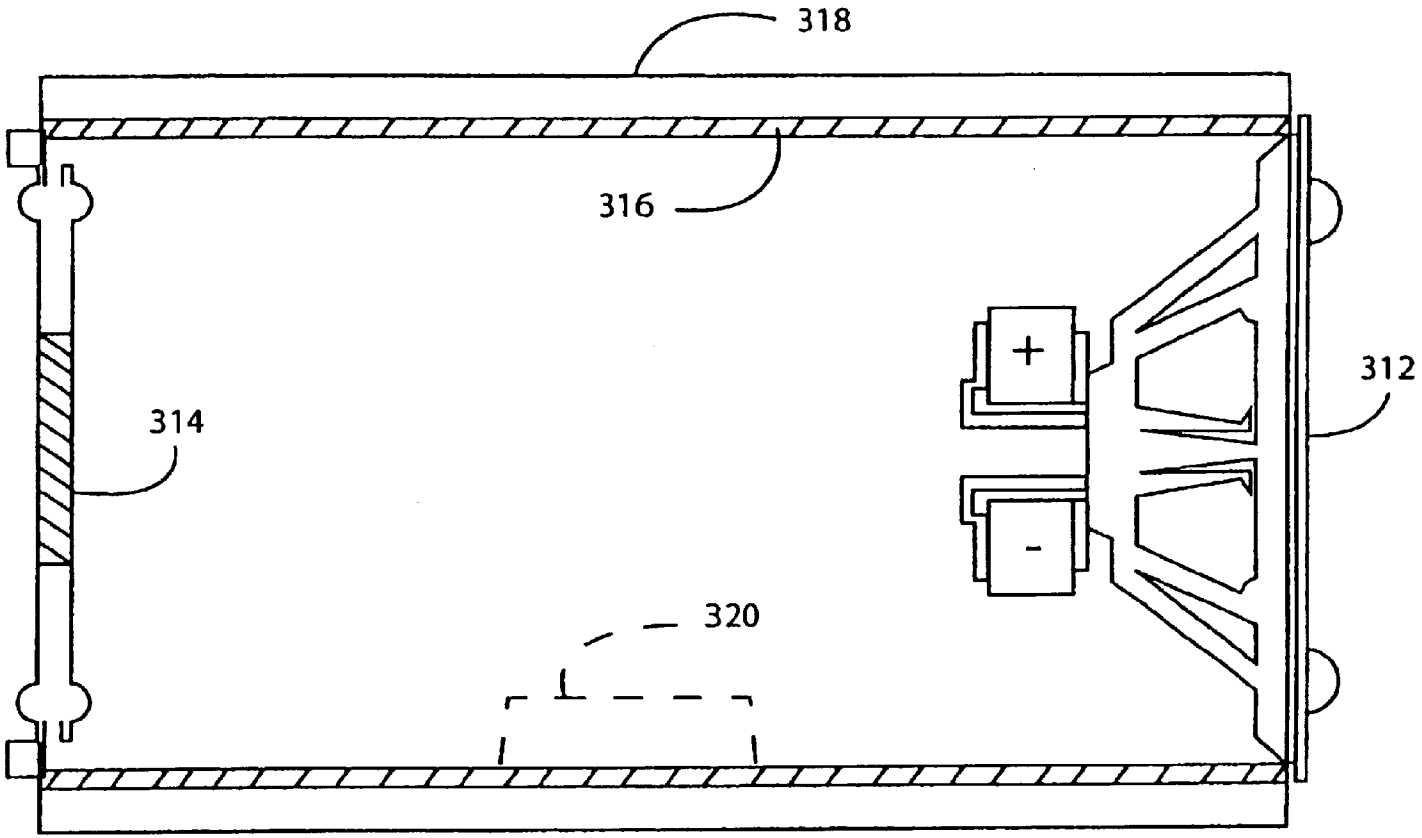
FIG. 35 is a schematic cross sectional view of the tube enclosure for the speaker system of FIG. 34, with an active element at one end and a passive element at the other end, the tube is made of aluminum, and may have fins to assist in cooling.

Another configuration according to the invention, showing a speaker and a passive radiator in an enclosure is shown in FIGS. 34 and 35. A speaker enclosure, not unlike the speaker boxes of FIGS. 21,22,23 and 24, is specially configured in a tube shape. A 35 driver (speaker) 312 at one end and a passive radiator 314 according to the invention at the other end. Passive radiators as shown and described in FIGS. 9, 15, 16, 17,29, 30, 31, 32 and 33 can be used. One of the biggest reasons for failure of voice coils of speakers is embrittlement and insulation breakdown due to high temperatures. In a dosed box system where there is no transfer of air between the inside and outside, thermal energy is not dissipated quickly. In the present configuration the tube 316 containing the speaker and driver is made of aluminum and made be fitted with perimeter ribs 318 to enhance cooling. Measurements have shown that the temperature of the air inside the tube shows a drop of 5° F. inside the tube at moderate speaker power levels when the ambient surrounding temperature is about 70° F. Such a reduction in voice coil temperature is significant. When an amplifier (e.g., 320) is mounted in the tube as well the air temperature reduction due to the use of a high thermally conductive material such as aluminum will be even more significant.

Low Profile, Shallow Speaker Embodiments

The various embodiments of the present invention permit the designer to maximize air movement in a given mounting depth with a configuration that optimizes the operation of the moving parts (i.e., diaphragm, suspension and voice coil) in the electromagnetic environment that complements the fixed mechanical structural configuration of the non-moving parts. In one embodiment, this invention allows the designer to have an over excursion (outward/inward limiter) that is optimized with the available mounting depth. For example, the present invention allows the designer to have a 15" diameter speaker that fits in a mounting depth of as little as 3.5" with a diaphragm excursion of approximately ±1", while a conventional speaker with the same size working piston requires a mounting depth of 6" to 7".

FIGS. 36A through 45B illustrate a variety of embodiments of low profile, shallow speaker embodiments of the present invention that are mountable in shallow, small clearance locations. To simplify the understanding of each of these embodiments, elements in the various figures that are the same have been given the same reference number. Those elements that are modified and which perform the same or similar function have the same number with the first use without a prime and for each variation one or more primes have been added to the reference number.

Figure 36A:
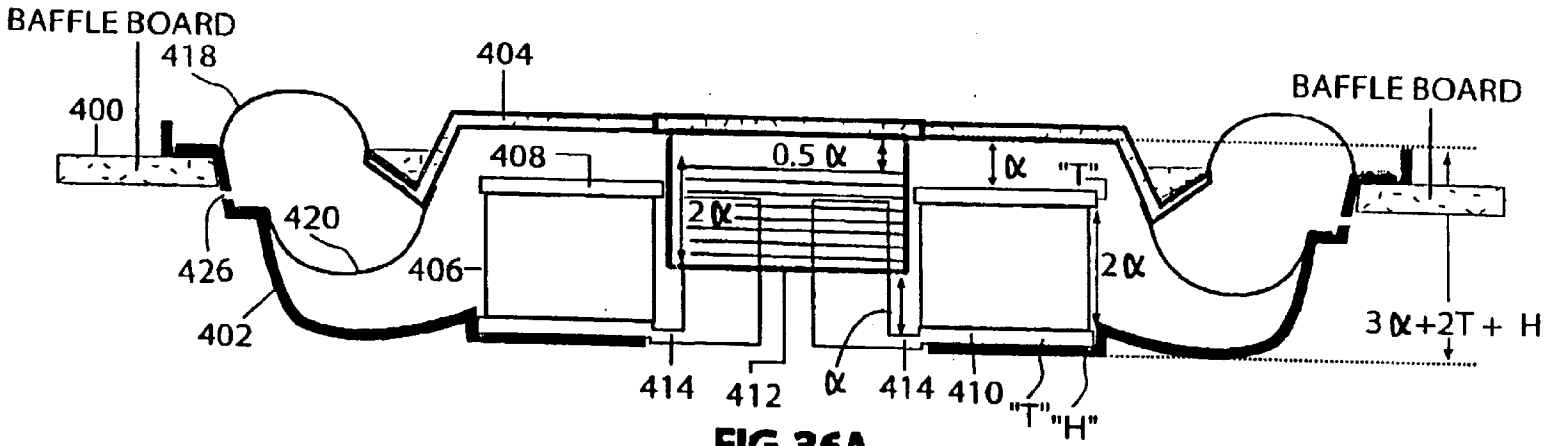
FIG. 36 show a first embodiment low profile, overhung, shallow speaker design in cross-section with FIG. 36A in the unexcited position, FIG. 36B in the maximum outward excursion position, and FIG. 36C in the maximum inward excursion position.
Figure 36B:
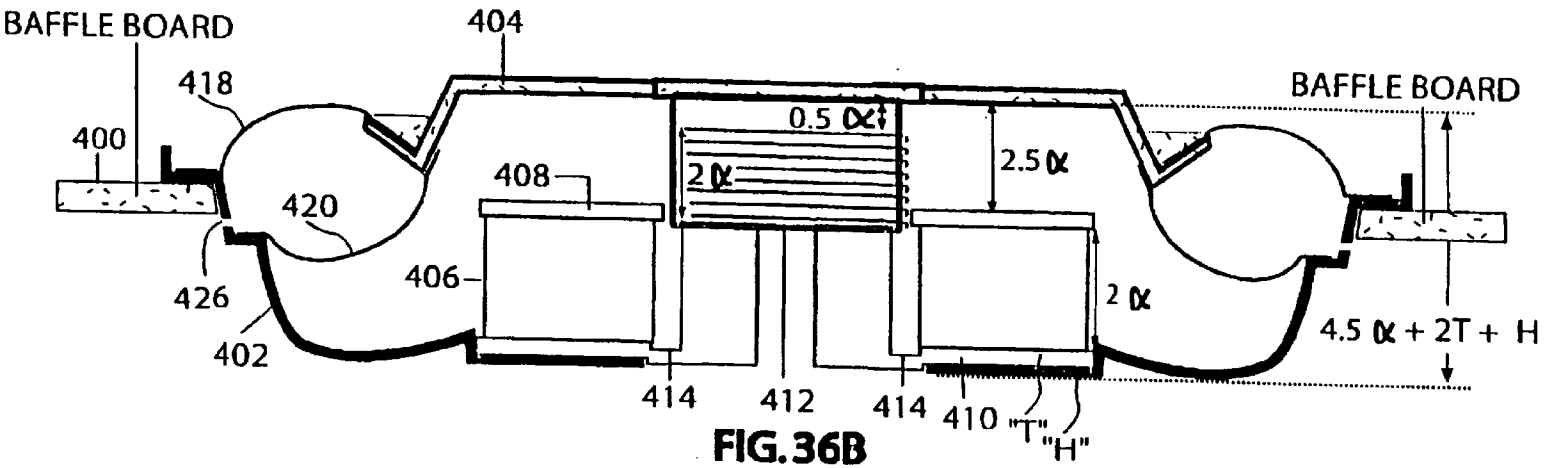
Figure 36C:
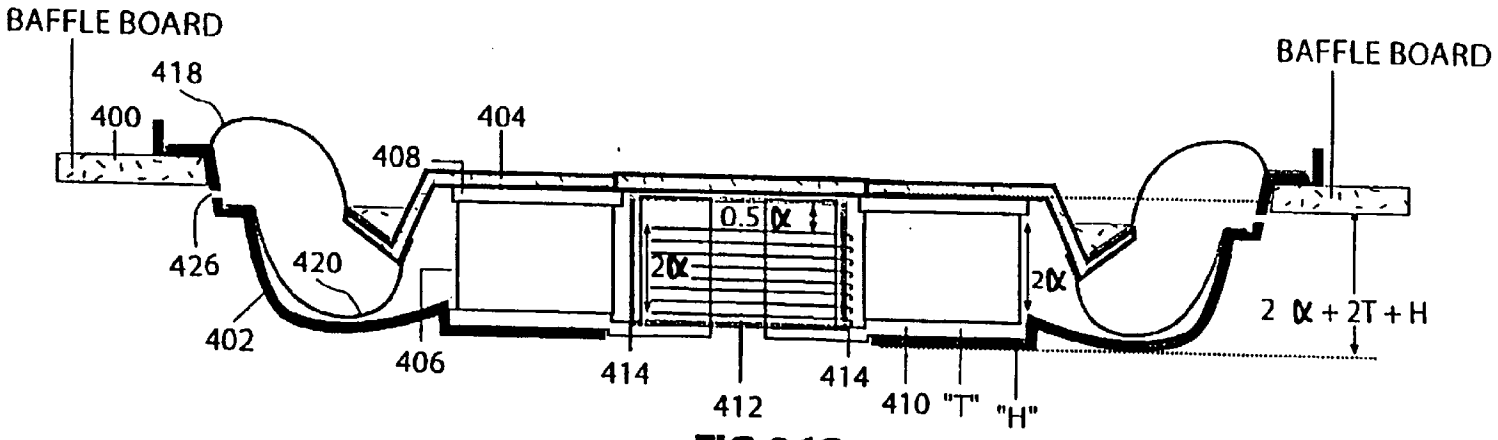

FIG. 36 show a first embodiment low profile, overhung, shallow speaker design with FIG. 36A in the unexcited position, FIG. 36B in the maximum outward excursion position, and FIG. 36C in the maximum inward excursion position. Included is a low profile frame or basket 402 that mounts to baffle board 400 in the installed location. Basket 402 has a bottom thickness of "H". In the bottom center of basket 402 is a typical overhung magnet/voice coil audio motor with an upwardly extending steel doughnut with an outwardly extending flange 410 with that flange having a thickness of "T". Mounted on the flange of doughnut 410 is a circular magnet 406 having a center hole that has a larger diameter than the diameter of the upwardly extending portion of the doughnut. Magnet 406 has a thickness of 2α. On top of magnet 406 is a steel ring 408 having outer and inner diameters that are approximately the same as those diameters of magnet 406. Ring 408 also has a thickness "T".

Additionally, there is a stiff, substantially flat diaphragm 404 with the diameter of the flat area being larger than the outer diameter of magnet 406. The outer most edge of diaphragm 404 is shown having a "V" shaped outer edge that extends downward and away at approximately 60°, however that specific angle is not critical to the design. Diaphragm 404 is ideally made of a material such as honeycomb, thin aluminum, or other composite and non-composite light-weight materials; conventional cone materials will not work in this application since the diaphragm is substantially flat and light-weight. Diaphragm 404 is suspended with two matched surrounds: an upwardly extending flexible surround 418 having an inner edge attached to the top of the outwardly extending leg of the "V" shaped edge of the diaphragm and an outer edge attached to the top, outer most flange of basket 402; and a downwardly extending flexible surround 420 having an inner edge attached to the bottom of the inner leg of the "V" shaped edge of the diaphragm and an outer edge attached to a point within basket 402 below the top, outer most flange. With surrounds 418 and 420 mounted in this way, maximum linearity of the inward/outward strokes of the speaker is achieved. Between the attachment points of surrounds 418 and 420, ventilation holes 426 have been formed around the circumference of basket 420. Attached to the lower center of diaphragm 404 is voice coil 412 that fits loosely around the upwardly extending portion of steel doughnut 410 with the upper most turn of the coil of voice coil 412 being spaced 0.5α below the inner surface of the diaphragm and the coil winding having a height of 2α in this overhung configuration. By making the height of the coil winding the same as the thickness of the magnet makes it possible to minimize the overall height of the speaker in every excited and unexcited positions of the diaphragm. With respect to each of the views of FIGS. 36A, 36B and 36C, and each of the embodiments discussed below, the thickness of diaphragm adds the same amount to the overall height of the speaker in each illustrated state, and since the thickness of the diaphragm can vary depending on the material used, for comparison purposes, the thickness of the diaphragm is not included in the height calculations.

FIG. 36A illustrates the position of the various components of this speaker embodiment when no current is flowing through voice coil 412 when the speaker is not being driven. In this position, surrounds 418, 420 are relaxed with the lower half of the coil winding is opposite the upper half of the magnet and the inner surface of diaphragm 404 spaced apart from the upper surface of ring 408 by a distance of a. Thus the overall height of the speaker is the spacing between diaphragm 404 and ring 408, α, plus the thickness of ring 408, T, plus the height of magnet 406, 2α, plus the thickness of the flange of 410, T, plus the thickness of the bottom of basket 402, H, for a total of 3α+2T+H.

In FIG. 36B the speaker is in the maximum outwardly extending position with the surrounds both stretched upward and the bottom coil of the voice coil even with the upper surface of ring 408. In this position the speaker achieves the maximum height possible. Here the spacing between ring 408 and diaphragm 404 is 2.5α(the height of the coil, 2α, plus the spacing of the upper most turn of the coil 0.5α from the bottom surface of the diaphragm). Thus the overall height of the speaker in this state is that 2.5α, plus the thickness of ring 408 and the flange 410, each T for a total of 2T, plus the height of the magnet, 2α, plus the thickness of the bottom of the basket, H, for a total of 4.5α+2T+H.

In FIG. 36C the speaker is in the maximum inwardly extending position with the surrounds both stretched inward and the overall height of the coil of voice coil 412 directly adjacent magnet 406 with the inward pull of the speaker being limited by the inner surface of diaphragm 404 coming into contact with the top surface of ring 408. Note that a circular groove 414 has been provided in the flange to protect the bottom edge of the voice coil from bottoming out with the flange. In this position the speaker achieves the minimum height possible. That height is the thickness of the magnet, 2α, plus the thickness of ring 408 and the flange, each T, and the thickness of the bottom of the basket, H, for a total of 2α+2T+H.

Note that the outermost edge of suspension system 418, 420 and diaphragm 404 is entirely outside the outer diameter of magnet 406, thus allowing the suspension to extend below the top surface of ring 408 with surround 420 nearly extending to the bottom of the basket on the maximum inward excursion of the voice coil and diaphragm as shown in FIG. 36C. Thus, the suspension operational depth is not a limiting factor of the speaker basket design and the actual mounting depth of the speaker. As noted above the mounting depth and cone wobble control are interrelated in the speakers of the present invention; the closer the outer portion of the suspension is to an inner one, the chance of wobble increases as the mounting depth of the speaker becomes shallower. As can be seen in FIGS. 36A, B and C the spacing between the two surrounds 418 and 420 is maintained throughout the full range of travel of the diaphragm, thus minimizing the possibility of wobble.

Figure 39:
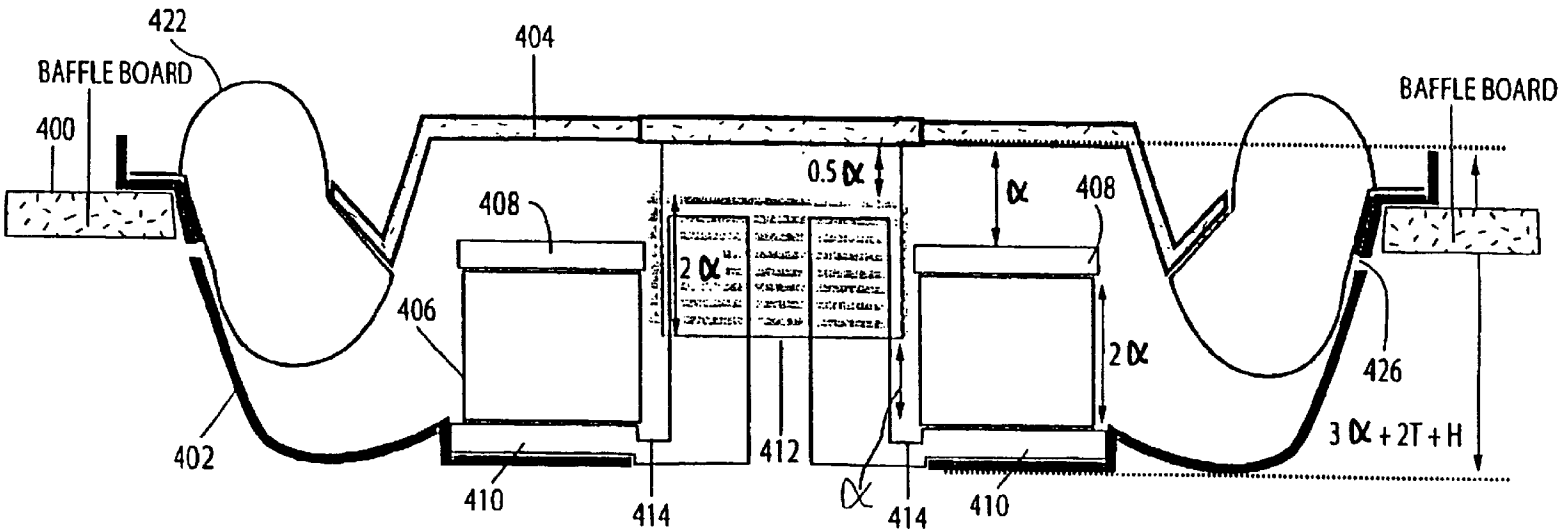
FIG. 39 shows the embodiment of FIG. 36A with a modified suspension.

FIG. 39 shows a second embodiment of an overhung, low profile speaker that is similar to that of FIG. 36A, the difference being that surrounds 418 and 420 have been replaced with a single bladder 422. In construction, bladder 422 is similar to a bicycle tube with the outer most side connected to inside top edge of basket 402 and an opposite side connected to the bottom of the outer most leg of the "V" shaped edge of diaphragm 404. Mounted in that way, a portion of bladder 422 extends upward like surround 418 while another portion extends downward into basket 420 like surround 420. In operation, bladder 422 performs similarly to the combination of surrounds 418 and 420 as discussed above in relation to FIGS. 36A, 36B and 36C.

By connecting the outer most side of bladder 422 to a lower point within basket 402 that is approximately horizontally even with the underside of the outer most leg of the "V" shaped edge of the diaphragm rocking of the diaphragm during speaker operation is minimized. Bladder 422 could be manufactured by injection molding and the wall thickness could be increased as necessary to achieve the desired performance. Additionally, to reduce internal pressure that develops during extreme in/out strokes, bladder 422 can have ventilation holes around the circumference to reduce internal pressure to allow air trapped within to leak into the space in which the speaker is mounted through ventilation holes 426. The overall height calculations for this embodiment are the same as for the first embodiment of FIG. 36A.

Figure 40:
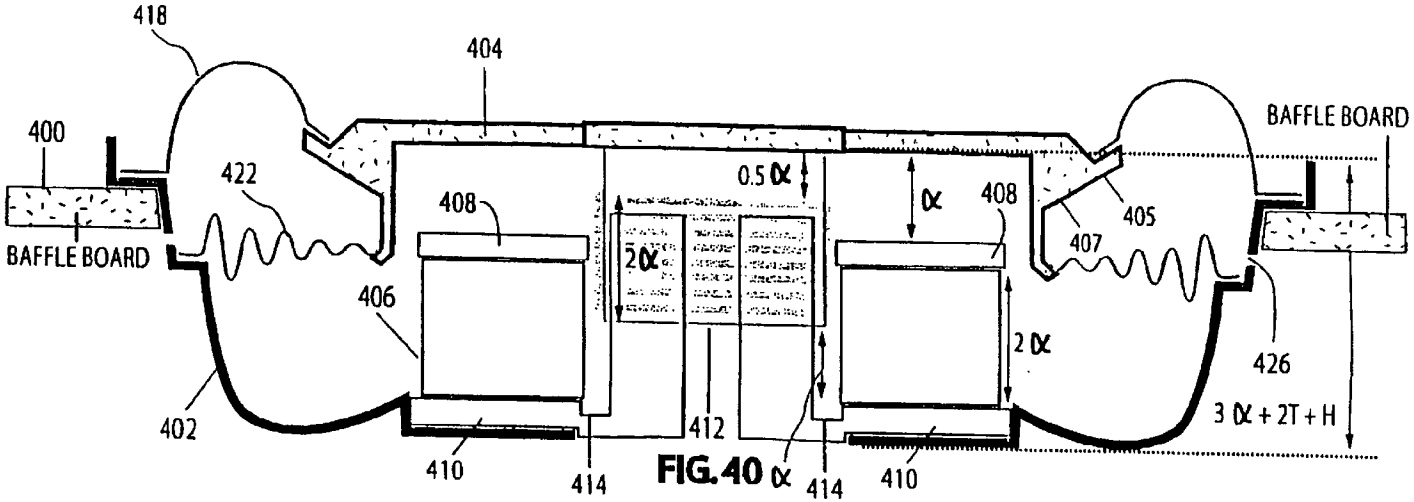
FIG. 40 shows the embodiment of FIG. 36A with a second modified suspension and a modified diaphragm configuration.
Figure 41A:
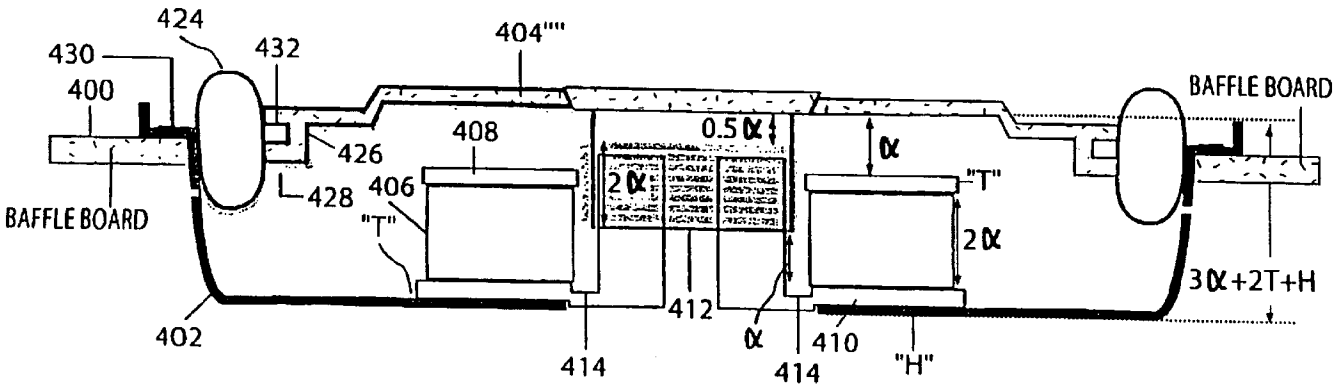
FIG. 41 show the embodiment of FIG. 36 with a third modified suspension and a second modified diaphragm configuration with FIG. 41A in the unexcited position, FIG. 41B in the maximum outward excursion position, and FIG. 41C in the maximum inward excursion position.
Figure 41B:
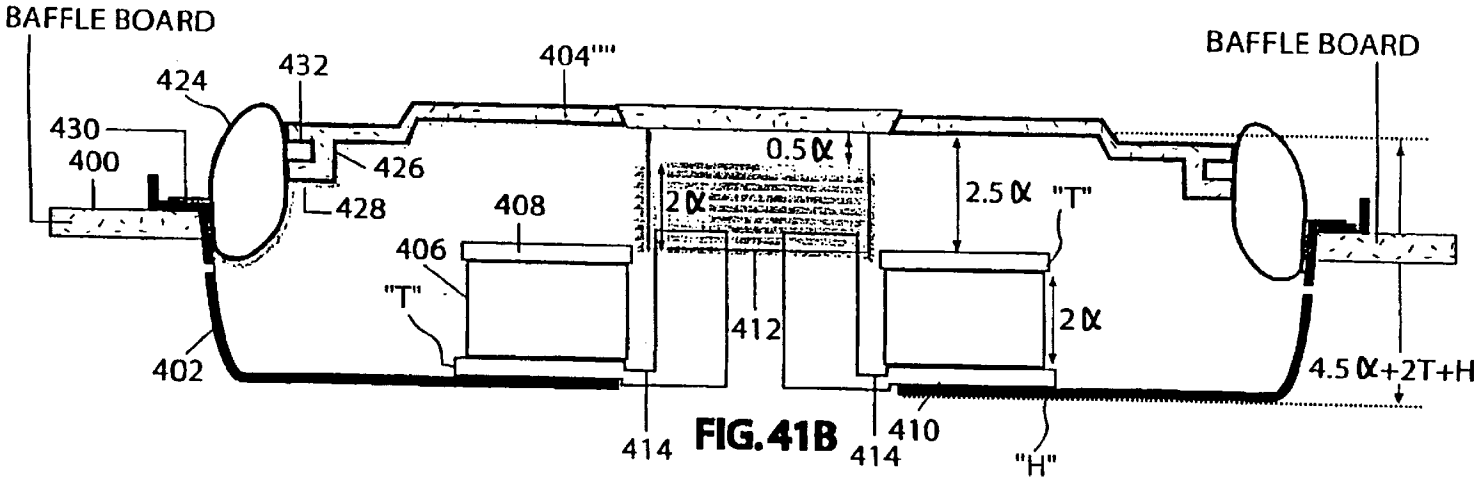
Figure 41C:
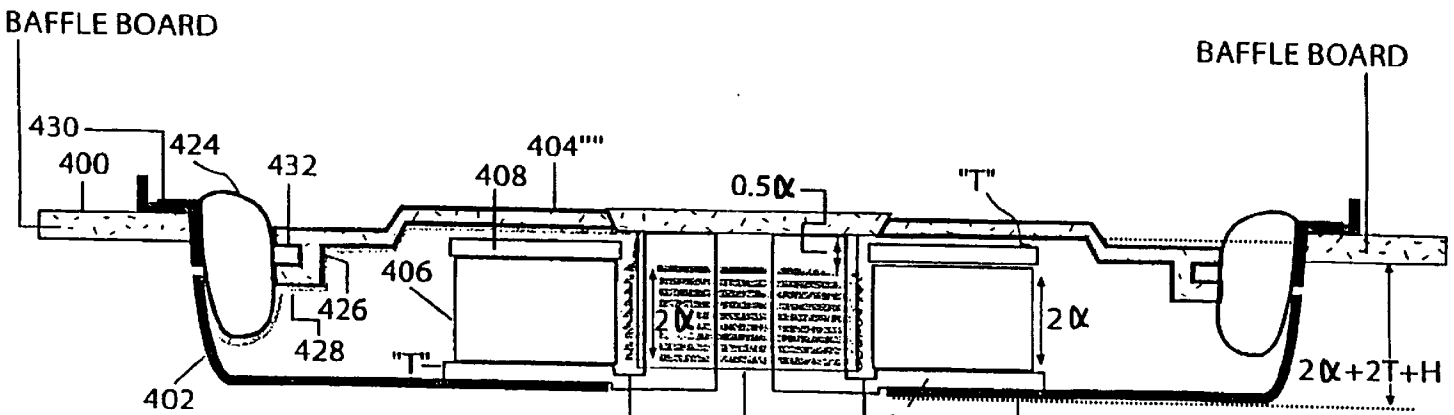

The third overhung, low profile speaker embodiment of FIG. 40 is also similar to the embodiment of FIG. 36A with two modifications—the outer edge shape of the diaphragm and the inner and outer surrounds. The outer edge of diaphragm 404'" of this embodiment has two suspension points, one being an upper outwardly small "V" shaped finger 405 that is slightly below the top surface of diaphragm 404'", and a downward extending finger 407 outside the diameter of magnet 406. Downward extending finger 407 also has formed to the end thereof a small outwardly extending flange. An outwardly extending surround 418' Is connected between the outer most leg of the small "V" shaped finger 405 and the top flange of basket 402, similar to surround 418 in FIG. 36A. Additionally, a spider 422 is connected between the small outwardly extending flange of downwardly extending finger 407 and a point within basket 402 below the top flange and ventilation holes 426, similar to the connection point of surround 420 in FIG. 36A. It should be noted that in this configuration spider 422 is mounted entirely outside the outer diameter of magnet 406, unlike the design of conventional speakers where the spider/cone connection is mounted directly over the magnet by a distance that is related to the desired travel of the speaker cone. With spider 422 mounted to the side of magnet 406 as in FIG. 40, the additional speaker height required in a conventional speaker is eliminated thus reducing the overall height of the speaker making a low profile speaker possible. In operation, surround 418' and spider 422 perform similarly to the combination of surrounds 418 and 420 as discussed above in relation to FIGS. 36A, 36B and 36C. The overall height calculations for this embodiment are the same as for the first embodiment of FIG. 36A.

FIG. 37 show a fourth embodiment of an overhung, low profile speaker of the present invention. This embodiment, as will be seen, has built in stops that define the maximum inward and outward travel of the diaphragm. Included in this embodiment is a speaker basket 402' with an outwardly extending upper flange that mounts to baffle board 400 of the mounting location of the speaker. Basket 402' has a bottom thickness "H". Mounted centrally within basket 402' is a post 428 having a threaded upper end 430 with the overall height of post 428 being less than the height of basket 402' from the bottom to the mounting flange. Also included is steel ring 408 magnetically adhering to the bottom of circular magnet 406 which in turn magnetically adheres to the flange of circular steel doughnut 410' with a hole therethrough that is tapped at the upper end. The flange of doughnut 410' and ring 408 each have a thickness "T", and magnet 406 has a thickness 2α' (note the distance α' in this figure is not necessarily the same as the distance a in FIG. 36). Doughnut 410' is screwed onto the top of post 428 with the ring/magnet/doughnut 408, 406, 410' assembly having a substantially uniform diameter that is suspended above the bottom of the basket. Note that doughnut and flange 410' is substantially the same as doughnut 410 in FIG. 36 with the addition of the tapped center hole and being mounted inverted to that of FIG. 36.

In this embodiment, diaphragm 404' consists of to two elements—a flat ridged top disk 413 and a circular enclosure 409 to the top of which top disk 413 is coupled. Circular enclosure 409 has cylindrical open interior with an inner diameter that is greater than the diameter of assembly 410, 406, 408' that opens to the opening in the basket. Through the center of bottom portion 411 of enclosure 409 is a circular hole that has a diameter substantially equal to that of voice coil 412 with the lower end thereof coupled within the bottom hole of enclosure 409. Voice coil 412 extends upward and fits loosely around the downwardly extending portion of steel doughnut 410' with the lower most turn of the coil of voice coil 412 being spaced 0.5α' above the inner surface of bottom portion 411 and the coil winding has a height of 2α' In this overhung configuration. Additionally, the inner depth of enclosure 409 is 2α'. Extending radially outward from enclosure 409 is a ring with the outer edge undercut inward shown here at approximately 45°, however the undercut angle is not critical to the operation of the speaker. The outwardly extending ring of the enclosure is coupled to the mouth of the basket by surrounds 418, 420 similar to that shown in FIG. 36A.

Figure 37A:
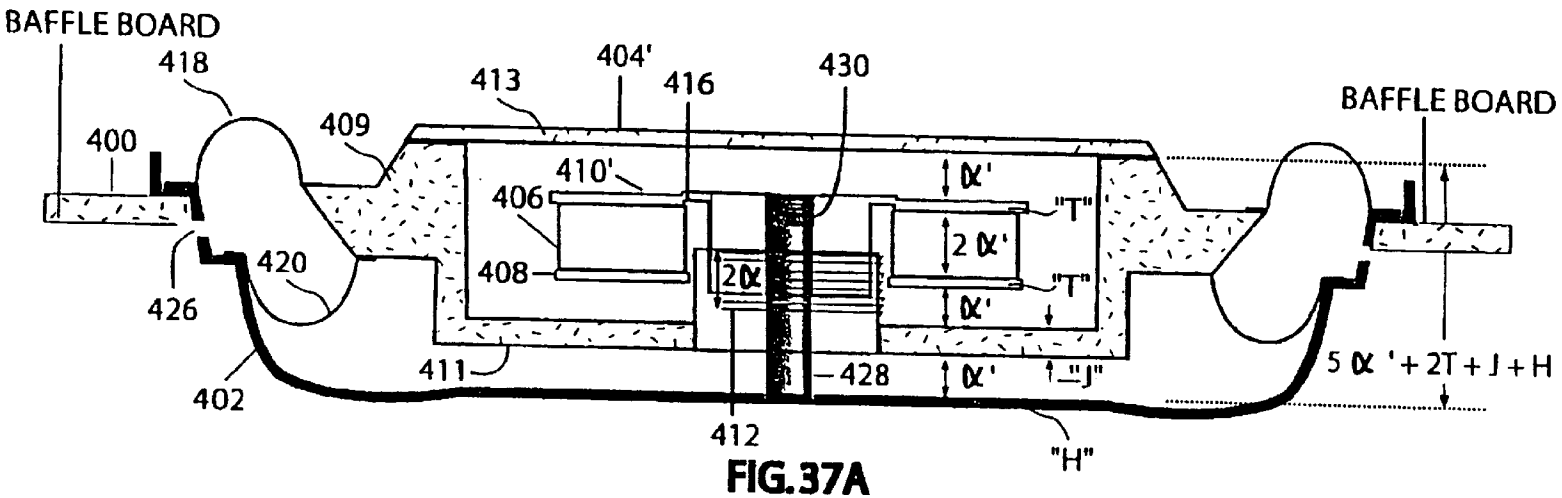
FIG. 37 show a second embodiment low profile, overhung, shallow speaker design in cross-section with FIG. 37A in the unexcited position, FIG. 37B in the maximum outward excursion position, and FIG. 37C in the maximum inward excursion position.

FIG. 37A illustrates the position of the various components of this speaker embodiment when no current is flowing through voice coil 412 and when the speaker is not being driven. In this position, surrounds 418, 420 are relaxed with the upper half of the voice coil winding is opposite the lower half of the magnet, and the inner surface of plate 413 of diaphragm 404' is spaced apart from the upper surface of the flange of 410' by a distance α'. Thus the overall height of the speaker is the distance between diaphragm 404' and the upper surface of 410', α', plus the thickness of 410', T, plus the height of magnet 406, 2α', plus the thickness of ring 408, T, plus the spacing between ring 408 and the inner surface of 411, α', plus the thickness of 411, J, plus the distance between 411 and the bottom of the basket, α', plus the thickness of the bottom of basket 402', H, for a total of 5α'+2T+J+H.

Figure 37B:
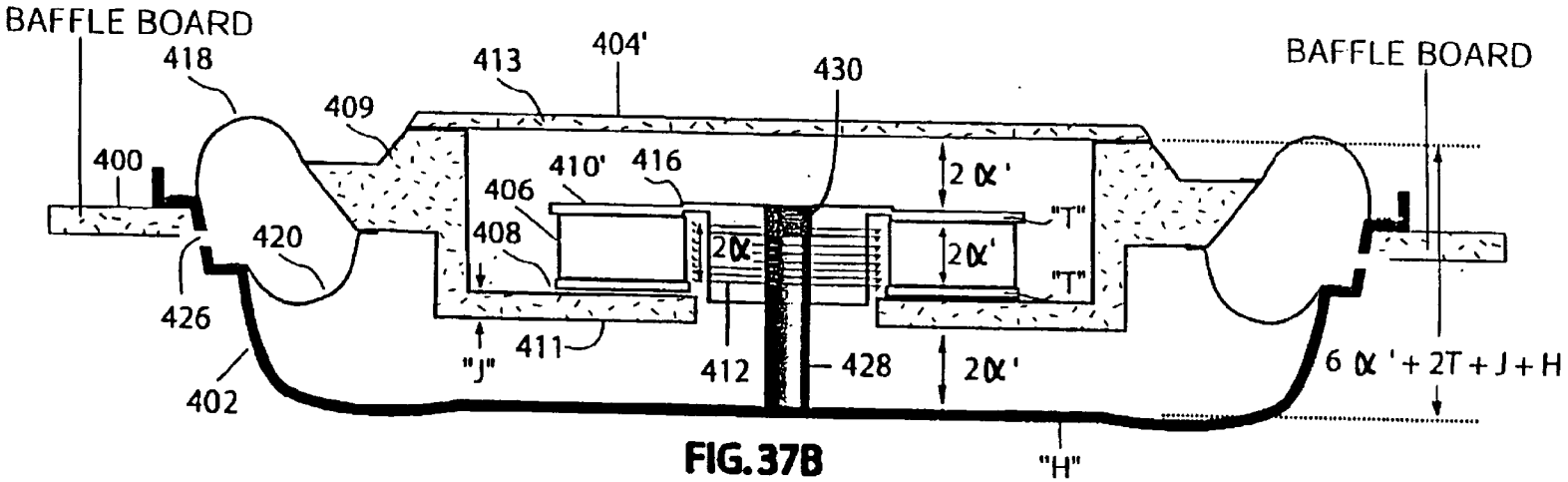

In FIG. 37B the speaker is in the maximum outwardly extending position with the surrounds both stretched upward, voice coil 412 is fully within the inner diameter of magnet 406, and the bottom 411 of enclosure 409 is in contact with the lower surface of ring 408 being pulled into that position by the fact that voice coil 412 is connected to 411. Note that a circular groove 416 has been provided in the flange to protect the top edge of the voice coil bobbin from bottoming out with the flange. This contact between 411 and the bottom of 408 stops of the upward travel of diaphragm 404'. In this position the speaker achieves the maximum height possible. In this configuration the height of the speaker is the spacing between plate 413 of diaphragm 404' and 410', 2α', plus the thicknesses of 410' and ring 408, each T, plus the height of magnet 406, 2α, plus the thickness of 411, J, plus the distance between 411 and the bottom of the basket, 2α', plus the thickness of the bottom of basket 402', H, for a total of 6α'+2T+J+H.

Figure 37C:
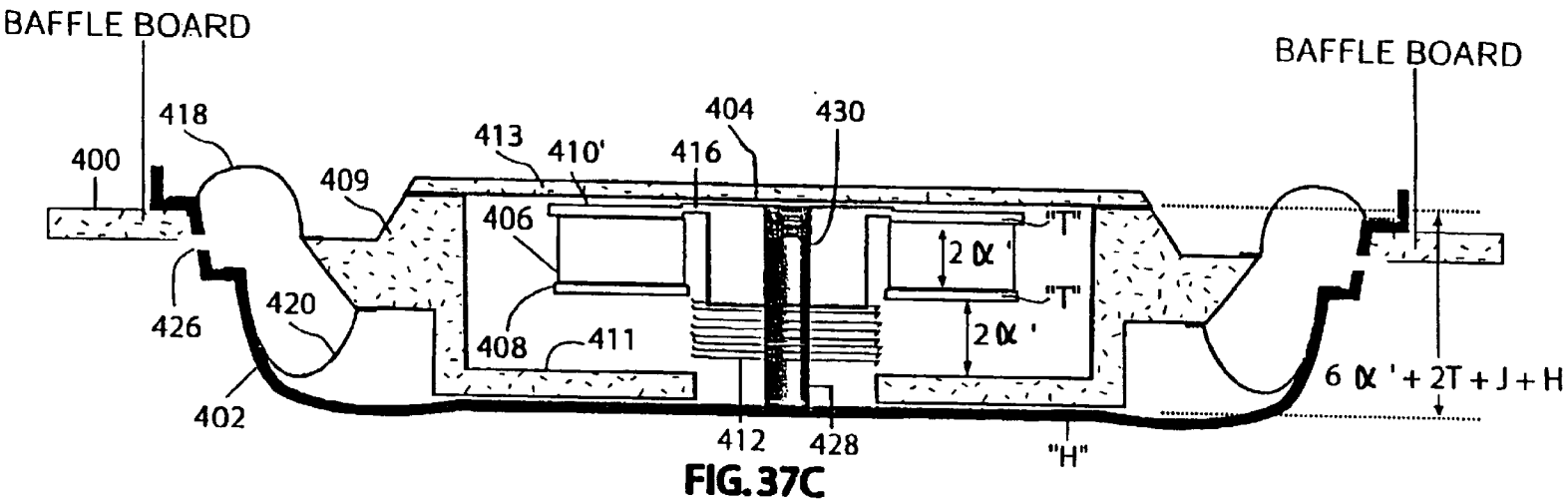

In FIG. 37C the speaker is in the maximum inwardly extending position with the surrounds both stretched inward and the overall height of the coil of voice coil 412 totally withdrawn from within the inner diameter of magnet 406 with the inward pull of the speaker being limited by the bottom surface of 411 coming into contact with the bottom of basket 402'. In this position the speaker achieves the minimum height possible. That height is the thicknesses of 410' and 408, each T, plus the height of the magnet, 2α, plus the thickness of 411, J, plus the thickness of the bottom of basket 402', H, for a total of 4α'2T+J+H.

Figure 38A:
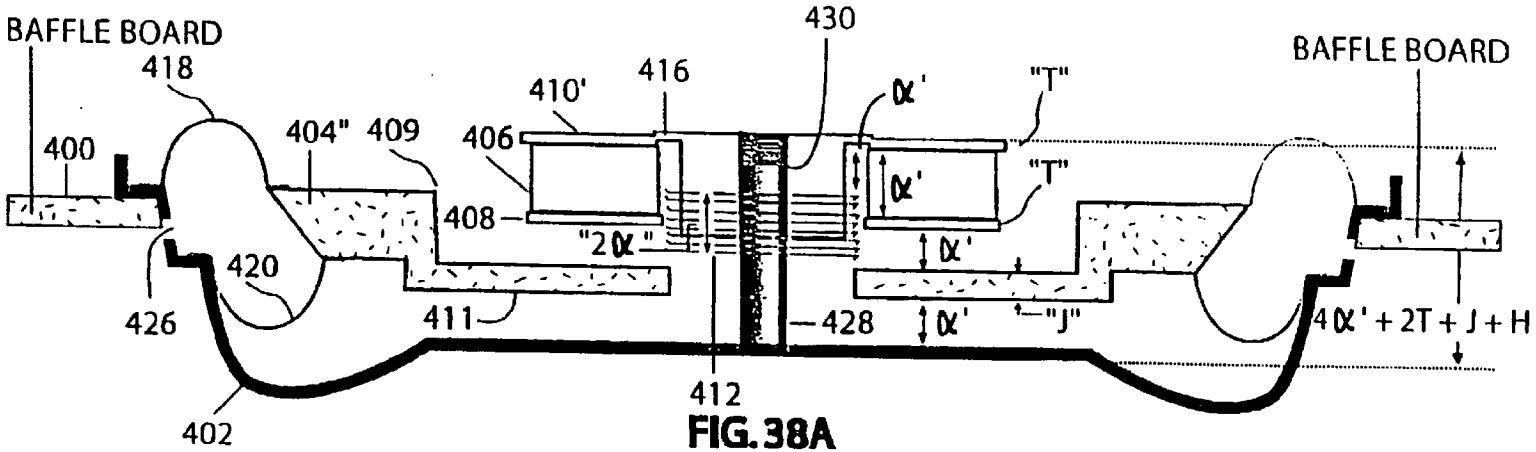
FIG. 38 show a third embodiment low profile, overhung, shallow speaker design in cross-section with FIG. 38A in the unexcited position, FIG. 38B in the maximum outward excursion position, and FIG. 38C in the maximum inward excursion position.

FIG. 38 show a fifth embodiment of an overhung, low profile speaker of the present invention that is similar to the fourth embodiment of FIG. 37 with the only difference being the configuration of the diaphragm which gives the speaker the same height regardless of the position of the diaphragm for all levels of excitation. This embodiment, as will be seen, also has built in stops that define the maximum inward and outward travel of the diaphragm. Given that only the diaphragm is different from the embodiment of FIG. 37, only the configuration of the diaphragm will be discussed here. Diaphragm 404" is similar to diaphragm 404' of FIG. 37, the difference being that diaphragm 404" does not have top plate 413 and the depth of enclosure 411' is only 2α' as compared to the 4α' depth of enclosure 411 of diaphragm 404' of FIG. 37. Thus, each of FIGS. 38A, B and C are similar to FIGS. 37A, B and C with all of the components in the same positions without plate 404' above 410'.

Thus the unexcited height of the speaker in FIG. 38A is the thicknesses of each of 410' and 408, each being T, plus the height magnet 406, 2α', plus the spacing between ring 408 and the inner surface of 411', α', plus the thickness of 411', J, plus the distance between 411' and the bottom of the basket, α', plus the thickness of the bottom of basket 402', H, for a total of 40α'+2T+J+H.

Figure 38B:
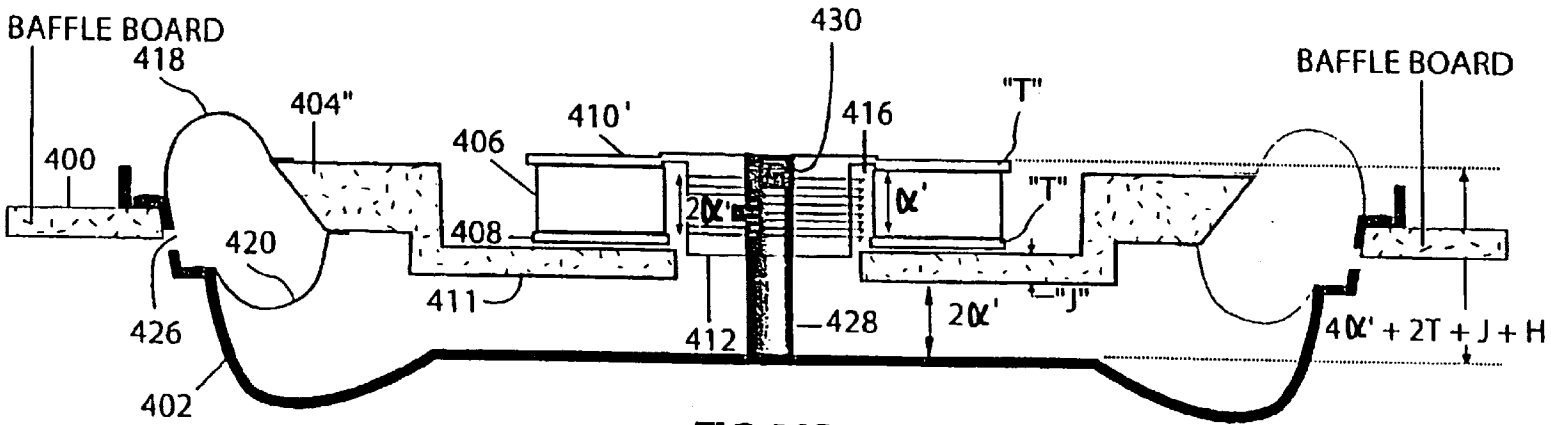

The maximum outward excited height of the speaker in FIG. 38B is the thicknesses of each of 410' and 408, each being T, plus the height magnet 406, 2α', plus the thickness of 411', J, plus the distance between 411' and the bottom of the basket, 2α', plus the thickness of the bottom of basket 402', H, for a total of 4α'+2T+J+H.

Figure 38C:
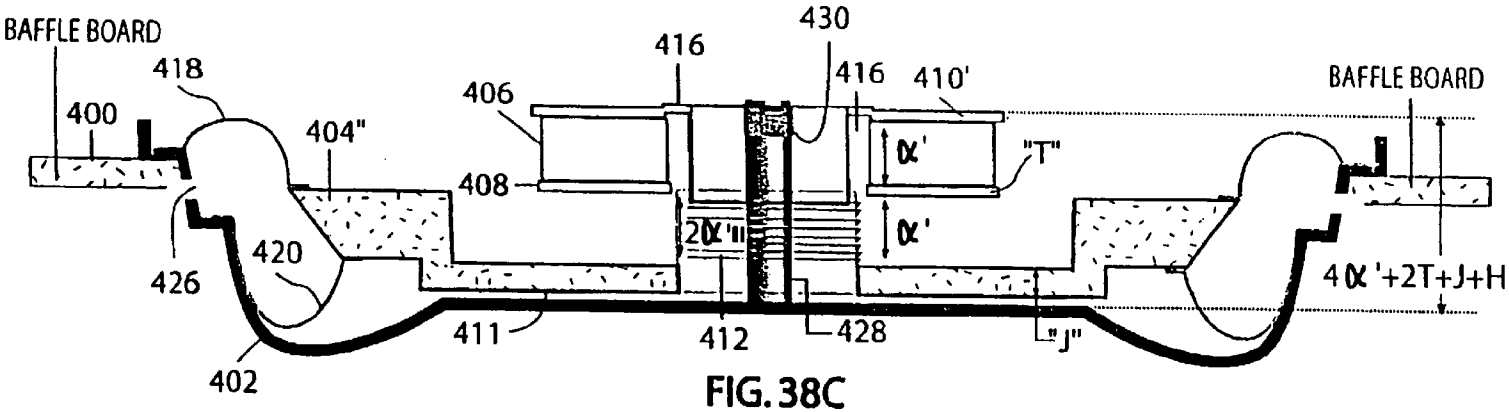

Similarly, the maximum inwardly excited height of the speaker in FIG. 38C is the thicknesses of each of 410' and 408, each being T, plus the height magnet 406, 2α', plus the spacing between ring 408 and the inner surface of 411' which is the same as the winding height of voice coil 412, 2α', plus the thickness of 411', J, plus the thickness of the bottom of basket 402', H, for a total of 4α'+2T+J+H.

FIG. 41 show a sixth embodiment of an overhung, low profile speaker of the present invention that is similar to the first embodiment shown in FIG. 36. The only differences between these two embodiments is in the outer edge of the diaphragm and the suspension between the diaphragm and the speaker basket. The various heights of this embodiment are the same as those of the first embodiment.

Diaphragm 404"" of this embodiment has an outer edge that is a two tine, horizontally extending fork with the upper surface of diaphragm 404"" forming a first tine 426 of the fork with the second tine 428 spaced apart from and below the first tine. In place of surrounds 418 and 420, the present embodiment utilizes a single support bladder 424 with a first mounting tab 430 extending outward for attachment to the outwardly extending flange of basket 402, and a second mounting tab 432 extending outward on the opposite side of the bladder from tab 430. Tab 432 is sized to fit between, and be captured within, the space between tines 426 and 428 on the outer edge of diaphragm 404"". In the unexcited state of the speaker shown in FIG. 41A, substantially equally sized portion of bladder 424 extend upward from basket 402 and downward into basket 402, similar to surrounds 418 and 420 in FIG. 36A. It can be seen from the maximum outwardly excited state shown in FIG. 41B and the maximum inwardly excited state shown in FIG. 41C, that bladder 424 is stretched in the same way as do surrounds 418 and 420 in FIGS. 36B and 36C. Thus the performance of this embodiment is substantially the same as the first embodiment of FIG. 36.

Figure 42A:
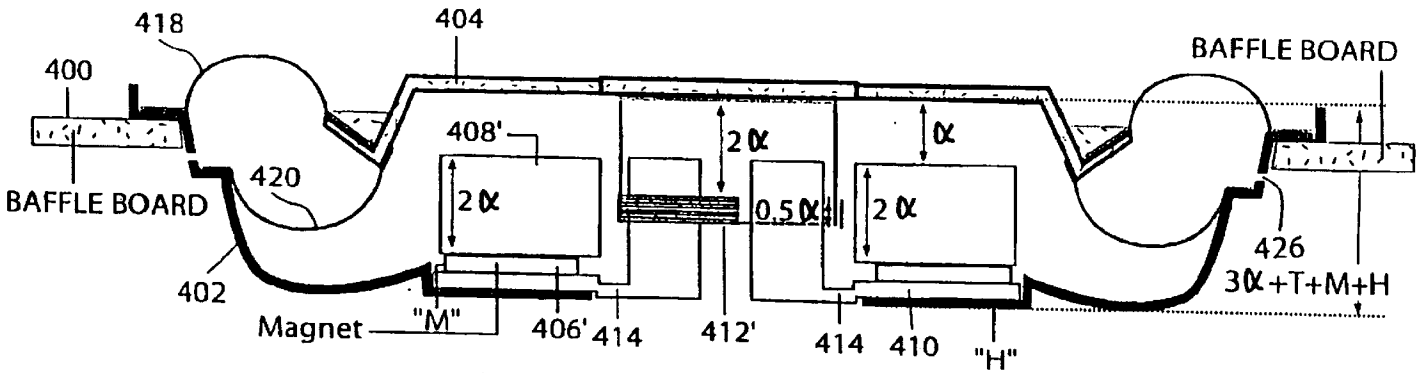
FIG. 42 show a first embodiment low profile, underhung, shallow speaker design in cross-section with FIG. 42A in the unexcited position, FIG. 42B in the maximum outward excursion position, and FIG. 42C in the maximum inward excursion position.

FIG. 42 illustrate a first underhung, low profile speaker embodiment of the present invention. This embodiment is similar to the overhung embodiment of FIG. 36 with only three changes. One change is the replacement of magnet 406 that has a height of 2α (FIG. 36) with magnet 406' with a height of "FM" (FIG. 42) in the same location of the structure. A second change is the replacement of steel ring 408 that has a thickness of "T" (FIG. 36) with a steel ring 408' with a thickness of 2α (FIG. 42). The third change is the replacement of voice coil 412 with a coil winding that is 2α high and spaced 0.5α below the underside of diaphragm 404 (FIG. 36) with a voice coil 412' with a coil winding that is 0.5α high and spaced 2α below the underside of diaphragm 404 (FIG. 42). With these changes the underhung, low profile speaker of FIGS. 42A, B and C performs in the same way as the overhung, low profile speaker of FIGS. 36A, B and C with the same overall heights of the speaker in each of the illustrated excitation/non-excited positions illustrated in FIGS. 36A, B and C and FIGS. 42A, B and C, respectively.

Namely, in FIG. 42A the overall height is the spacing height between the under side of diaphragm 404 and the top side of ring 408', α, plus the thickness of ring 408', 2α, plus the height of magnet 406', "M" (that is equal to "T"), plus the thickness of the flange on 414, "T", plus the thickness of the bottom of basket 402, "H", for an overall height of 3α+T+M+H which is equal to 3α+2T+H in FIG. 36A.

Figure 42B:
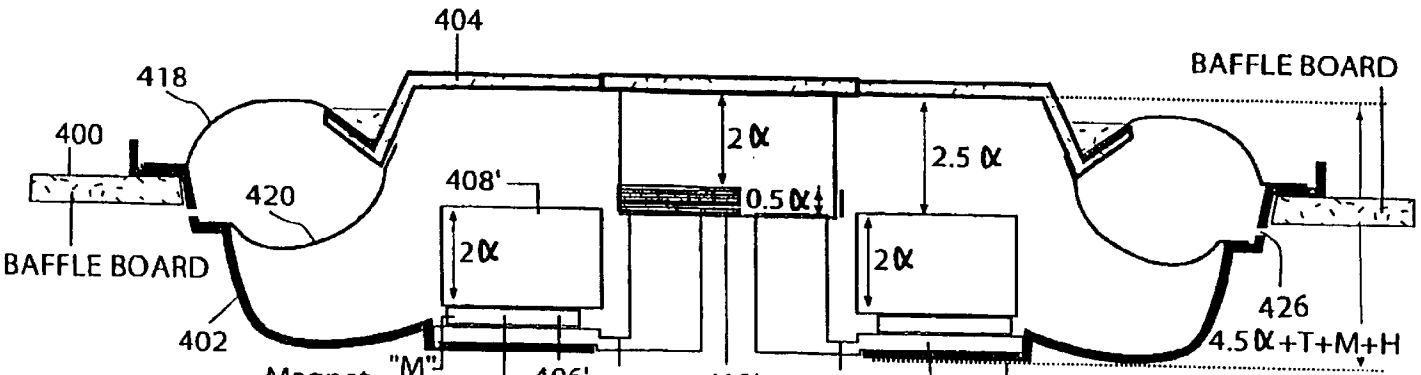

In FIG. 42B the overall height is the spacing of the winding of voice coil 412' from the underside of the diaphragm, 2α, plus the height of the coil winding, 0.5α, plus the thickness of ring 408', 2α, plus the height of magnet 406', "M" (that is equal to "T"), plus the thickness of the flange on 414, "T", plus the thickness of the bottom of basket 402, "H", for an overall height of 4.5α+T+M+H which is equal to 4.5α+2T+H in FIG. 36B.

Figure 42C:
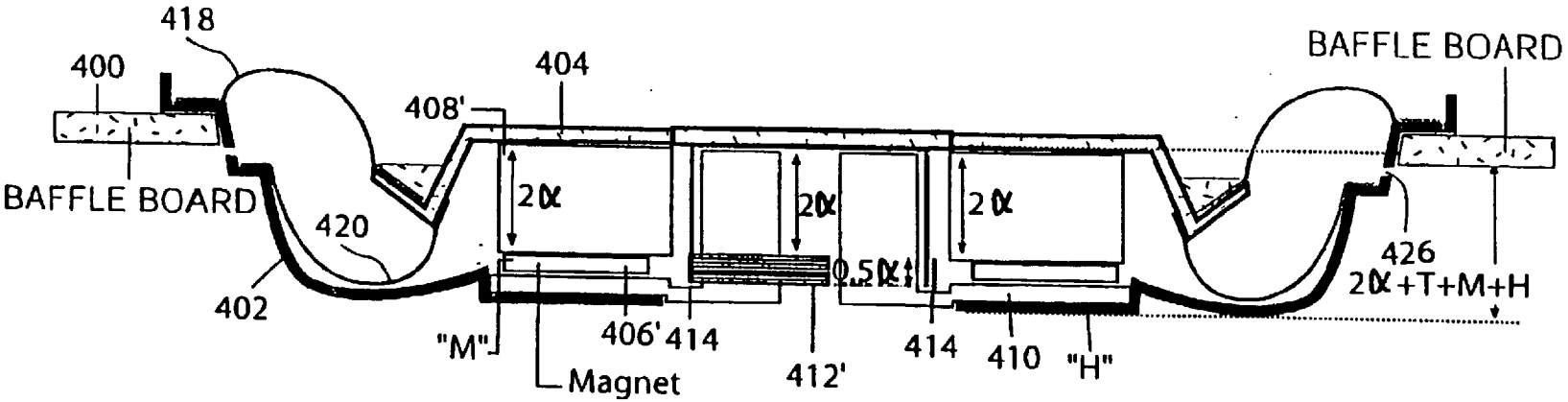

In FIG. 42C the overall height is the spacing of the winding of voice coil 412' from the underside of the diaphragm or the thickness of ring 408', 2α, plus the height of magnet 406', "M" (that is equal to "T"), plus the thickness of the flange on 414, "T", plus the thickness of the bottom of basket 402, "H", for an overall height of 2α+T+M+H which is=to 2α+2T+H in FIG. 36C.

Figure 43A:
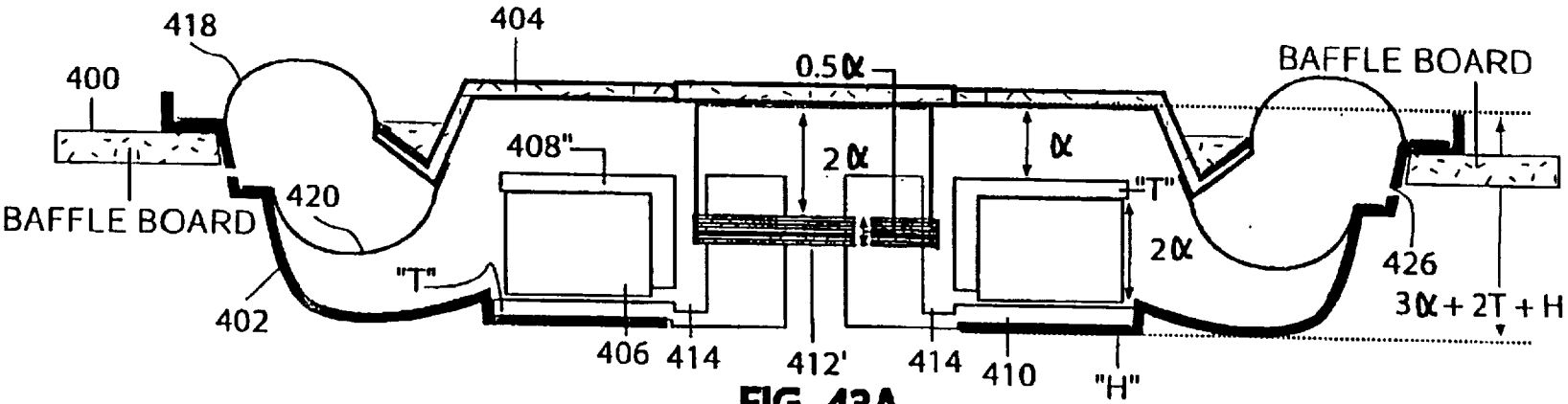
FIG. 43 show a second embodiment low profile, underhung, shallow speaker design in cross-section with FIG. 43A in the unexcited position, FIG. 43B in the maximum outward excursion position, and FIG. 43C in the maximum inward excursion position.
Figure 43B:
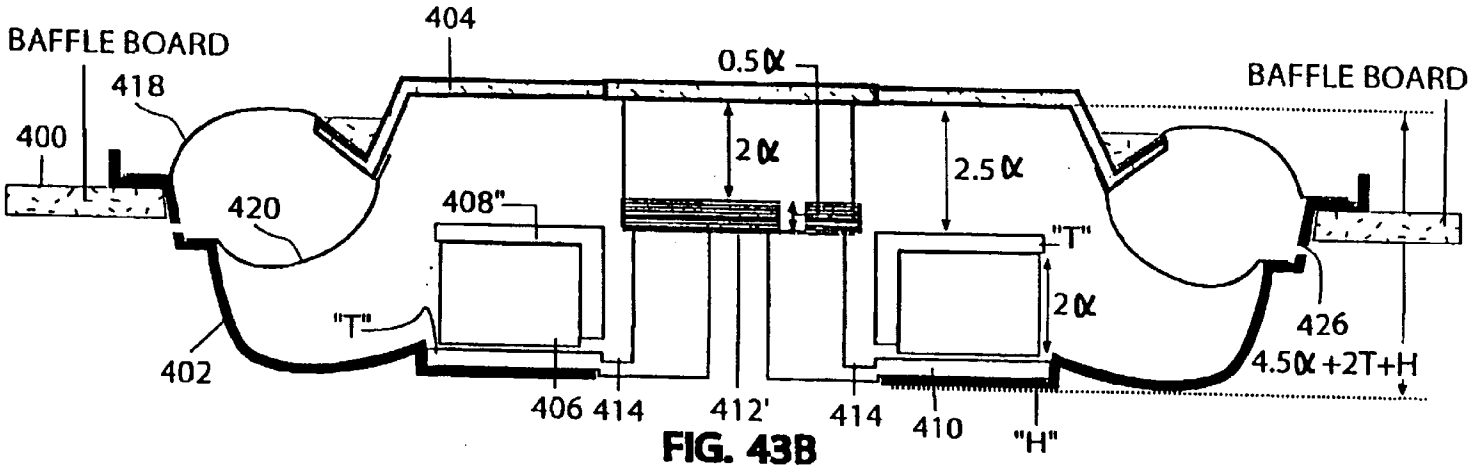
Figure 43C:
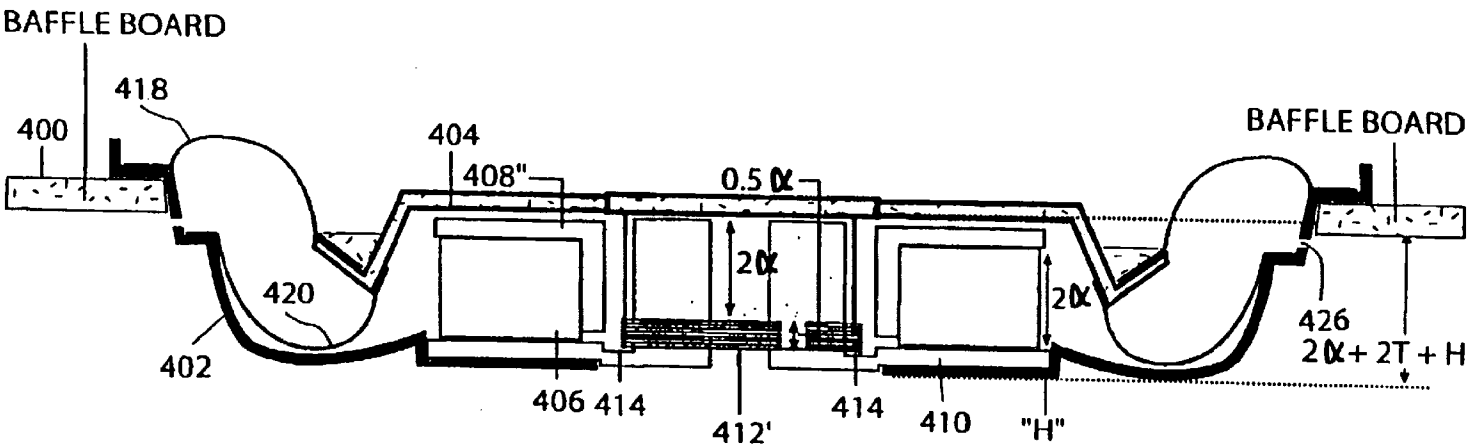

A second embodiment of an underhung, low profile speaker of the present invention is illustrated in FIG. 43. This embodiment is also similar to the first overhung embodiment of FIG. 36 with two changes to the speaker structure. One change is the replacement of voice coil 412 with a coil winding that is 2α high and spaced 0.5α below the underside of diaphragm 404 (FIG. 36) with a voice coil 412' with a coil winding that is 0.5α high and spaced 2α below the underside of diaphragm 404 (FIG. 43). The other change is the replacement of steel ring 408 (FIG. 36) with a second steel doughnut 408" with a flange inverted over magnet 406. The doughnut portion of 408" having an outer diameter that is substantially the same as the inner diameter of magnet 406, and an outer diameter that is substantially less than the outer diameter of the doughnut portion of 410 thus leaving a space between the two doughnuts that is significantly wider than the thickness of the mounting ring of voice coil 412'. The doughnut portion of 408" extends down the inside surface of the magnet, nearly the entire height of the magnet leaving a space between the bottom end of 408" and the upper surface of the flange of 410. The flange portion of 408" having a thickness, "T", that is the same as the thickness of ring 408 in FIG. 36. The doughnut portion of 408" being needed to extend the effect of the upper pole of magnet 406 (typically considered to be the North pole) into the space traversed by the winding of voice coil 412' to permit operation of the speaker in an underhung configuration.

Figure 45A:
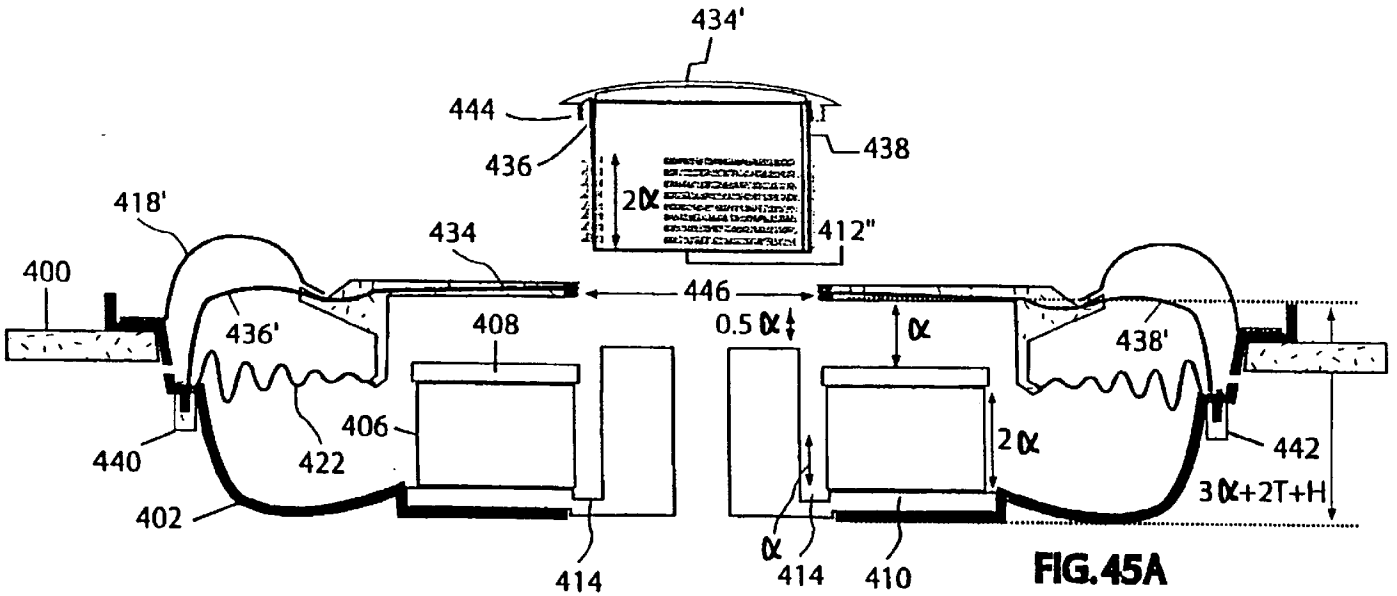
FIG. 45 show a first embodiment low profile, shallow speaker design in cross-section having a replaceable voice coil with FIG. 45A showing the voice coil external to the reminder of the speaker, and FIG. 45B showing the voice coil installed in the speaker.
Figure 45B:
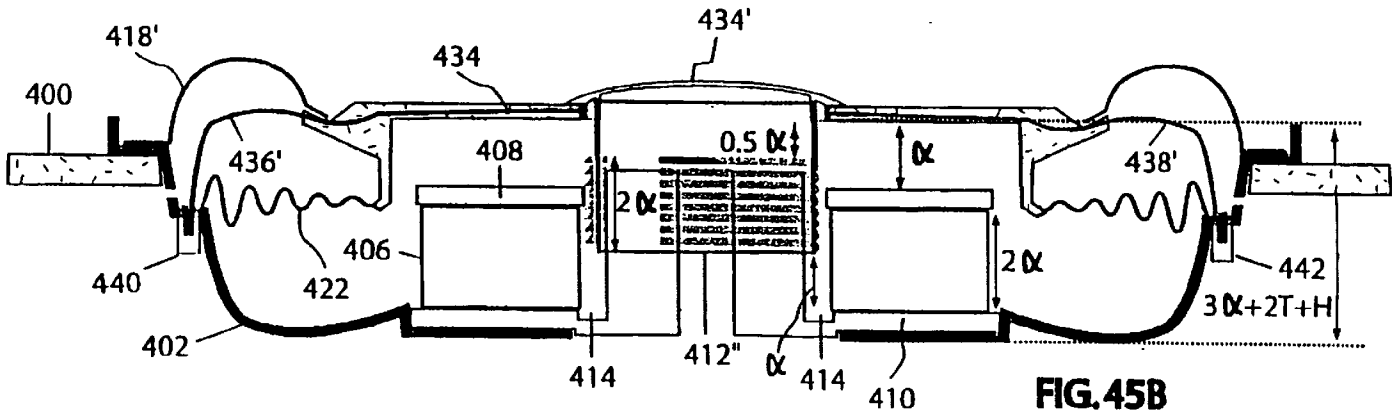

FIG. 45 show an embodiment of a speaker with a replaceable voice coil, the speaker otherwise being similar to the speaker shown in FIG. 40. In FIG. 45A there is shown in the upper part of that figure, the removable/replaceable voice coil assembly and in the lower part of that figure the assembled other components of the speaker. In addition to what is shown in FIG. 40, the lower part of FIG. 45A also includes a modified diaphragm 434 that is similar to diaphragm 404'" with the center removed from above the location for the voice coil. The diameter of the center hole in diaphragm 434 being slightly larger than the diameter of voice coil 412" shown in the upper part of FIG. 45A. Forming the edge of the center hole in diaphragm 434 is a bifurcated conductive internally threaded ring 446 that is described more fully below. In this view, the left side of ring 446 is electrically connected to conductor 436 that is molded into the diaphragm and passes through the space between surround 418' and spider 422 on the left side and is then coupled to connector 440 that is disposed to be connected to an amplifier to apply signal to the voice coil. Similarly, the right side of ring 446 is electrically connected to conductor 438 that is molded into the diaphragm and passes through the space between surround 418' and spider 422 on the right side and is then coupled to connector 442 that is also disposed to be connected to an amplifier to apply signal to the voice coil.

The voice coil assembly in the upper portion of FIG. 45A includes voice coil 412" with the coil winding on a typical voice coil bobbin. One lead wire 436 of the coil is shown extending to the top of the bobbin on the left side, while the other lead wire of the coil is shown extending to the top of the bobbin on the right side. Surrounding the top of the voice coil bobbin is a bifurcated conductive externally threaded ring 444 that is described more fully below. The left conductive half of ring 444 has lead wire 436 connected thereto, while the right conductive half of ring 444 has lead wire 438 connected thereto. Then covering the top of the bobbin is circular cap 434' that closes the center of diaphragm 434 when voice coil 412" is installed as in FIG. 45B. Voice coil 412" is installed by inserting the lower end of the bobbin first through the central hole in diaphragm 434 and then screwing ring 444 into ring 446 and positioning the left half of ring 444 on the bobbin opposite the left half of ring 446 which then causes the right half of ring 444 to be in contact with the right half of ring 446. When so positioned, lead wire 436 is electrically connected, through the left half of rings 444 and 446 with wire 436 and connector 440, and similarly lead wire 438 is electrically connected, through the right half of rings 444 and 446 with wire 438 and connector 442.

Figure 44B:
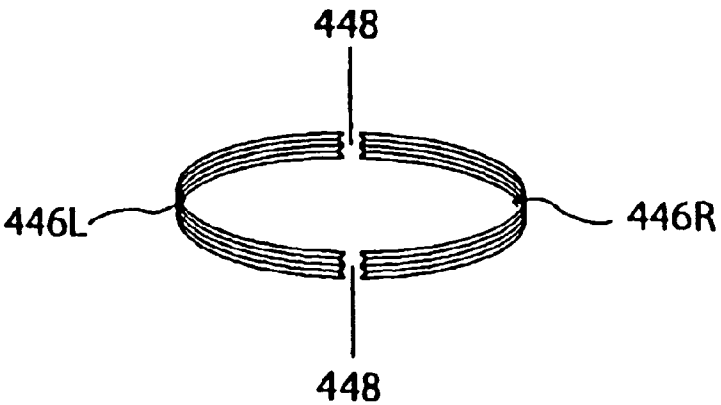
FIG. 44 show an attachment mechanism for the replaceable voice coil of FIG. 45 with FIG. 44A being an exploded, perspective view of the voice coil attachment components and FIG. 44B being a perspective view showing the screw type conductors of FIG. 44A in a joined position.
Figure 44A:
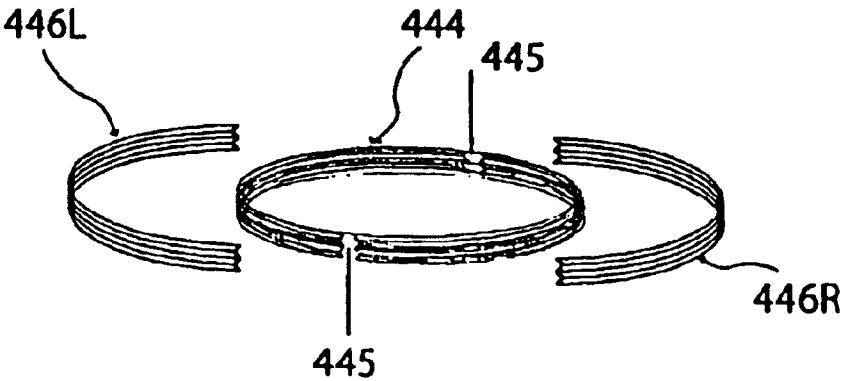

The details of rings 444 and 446 are shown in FIGS. 44A and 44B. In FIG. 44A ring 444 can be seen to consist of right and left halves which are bound together with non-conductive elements 445 (e.g., plastic or epoxy) to form the ring. Also shown in FIG. 44A are ring 446 sections 446L and 446R in an exploded relationship with respect to ring 444. Then in FIG. 44B, the two halves of ring 446 are shown assembled as is ring 444, with non-conductive elements 448 joining the two halves while electrically isolating one half from the other.

Figure 46A:
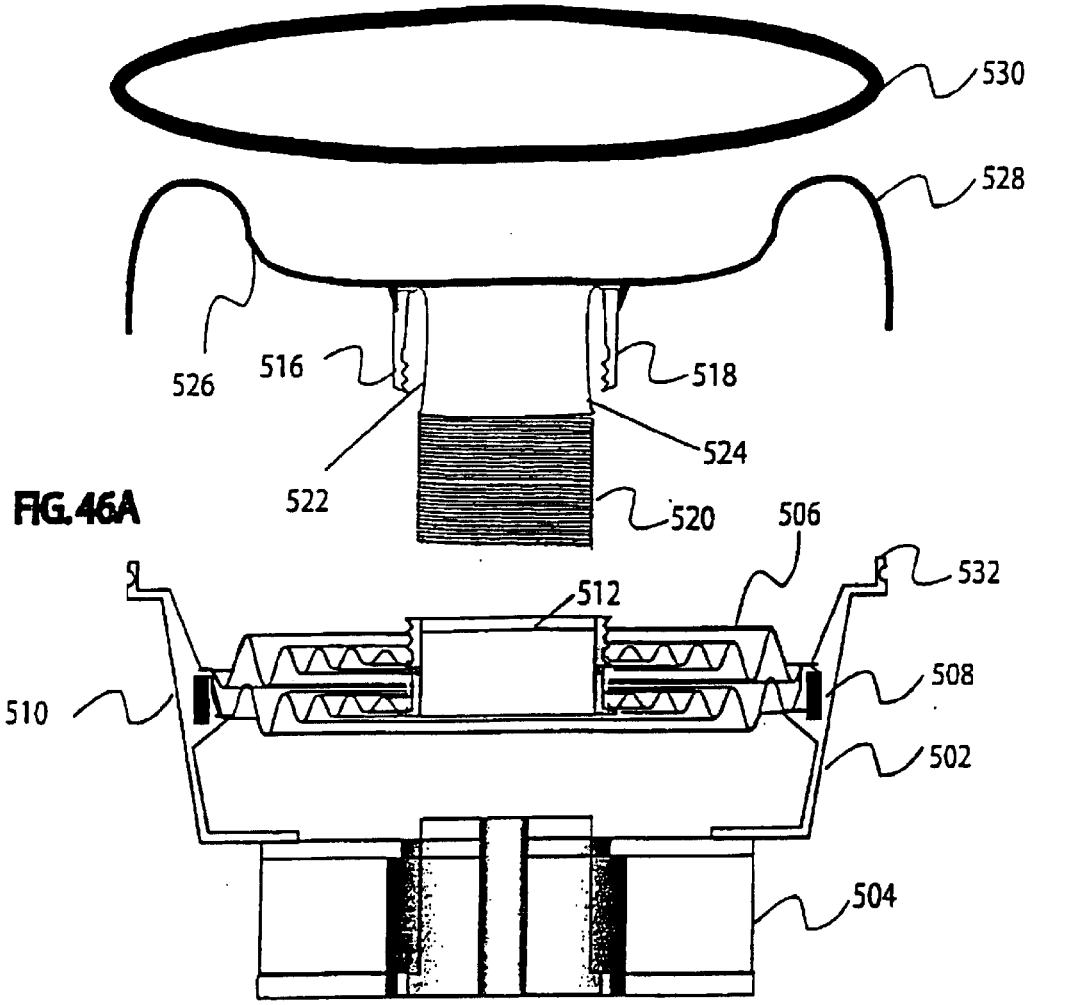
FIG. 46 show in cross-section a speaker in a conventional configuration with a replaceable cone and voice coil with FIG. 46A showing the cone removed and the details for attachment of the cone and voice coil to the remainder of the speaker.
FIG. 46B shows the fully assembled speaker.
Figure 46B:
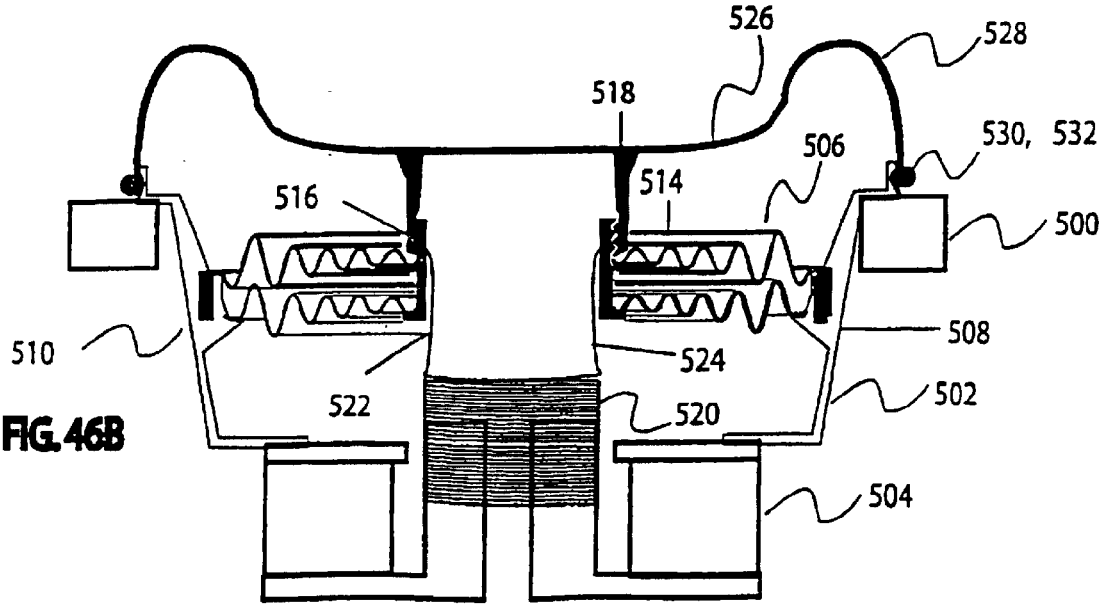

FIG. 46 are provided to illustrate a second embodiment of a speaker with a removable/replaceable cone or voice coil, or both. While the views shown in FIG. 46 are that of a conventional speaker, the same techniques can be used with low profile speaker. FIG. 46A shows an exploded view of the speaker of the this embodiment, and FIG. 46B shows the same speaker fully assembled. The speaker is to be mounted on a baffle board 500 with a flange of basket 502. Shown at the bottom of the basket is magnet assembly 504. Within the basket and above magnet 504, is a spider assembly 506 with a center cylinder 512 having external screw threads 514 around the upper end thereof. Cylinder 512 and threads 514 can be made of a non-conductive material, or threads 514 could be a conductive ring 446 such as that of FIG. 448. On the left side of cylinder 512, a conductive wire (not shown) extends from threads 514, through spider 506 to an external connector 510 that is disposed to be connected to an audio source. Similarly, on the right side of cylinder 512, a conductive wire (not shown) extends from threads 514, through spider 506 to an external connector 508 that is disposed to be connected to the same audio source. The purpose of these wires and external connectors will soon become apparent. Extending above the flange is a rim with a concave half circle groove 532.

Also included is a cone 526 with surround 528 bonded to the outer edge of the cone. Beneath the center of cone 526 is a voice coil 520 on a bobbin with one lead 522 from the coil extending up the left side of the bobbin to the underside of the cone, and on the right side of the bobbin the other lead 524 of the coil also extends upward to the under side of the cone. The bobbin can either be permanently fixed to the under side of the cone, or it can with ring 444 (FIG. 44A) to the top edge of the bobbin screwed into a ring 446 that is bonded to the underside of the cone.

Also connected to the underside of the cone, outside of, and spaced apart from, of the bobbin, is a downwardly extending cylinder that is approximately one third the length of the bobbin with an Internal thread at the lower end thereof. That cylinder includes a left conductive portion 516 and a right conductive portion 518 that are connected at their cone end to lead wires 522 and 524, respectively. Conductive portions 516 and 518 could be left and right sides of a ring such as ring 446, or lead wires 522 and 524 could be extended from the cone down into the Internal threads of 516 and 518.

The final step of assembly of such a speaker is the lowering of the cone/voice coil assembly to the mouth of basket 502 with the winding of the voice coil passing through the central cylinder supported by the spider with the windings of the coil extending to the magnet assembly. The cone/voice coil assembly is attached to the cylinder/spider assembly by mating the internal threads of the cylinder attached to the cone with the outer threads of the cylinder taking care to position the cone/voice coil assembly such that lead wires 522 and 524 are coupled to external connectors 510 and 508, respectively. Once the voice coil is positioned as such, the final step of assembly is the placement of the outer edge of surround 528 to the outside of the rim on the basket flange opposite the concave half circle groove 532. Then elastic ring 530 is placed around the so located outer edge of the surround to seat the edge of the surround in groove 532 and retained in that position by elastic ring.

With a speaker of this design, a user of such a speaker will be able to replace either the voice coil of the cone should they, or the surround be however damaged. Also the user will be able to interchange the cone and/or voice coil with those of a different design or configuration to produce a different audio response and sound from the speaker.

While the invention has been described with regard to several specific embodiments. Those skilled in the art will recognize that changes can be made in form and detail without departing from the spirit and scope of the invention. One skilled in the art will also find it obvious to extend the techniques discussed with respect to a passive radiator to and active speaker, and to also extend the techniques discussed relative to an active speaker to a passive radiator. This is true since a passive radiator is basically the same as a speaker without the electromagnetic engine for moving the diaphragm of the passive radiator. Thus, the protection afforded hereby is as stated in the accompanying claims and equivalents thereof.

What is claimed is:

1. A loudspeaker with removable/replaceable cone and voice coil comprising:

a frame having a bottom surface with a side portion extending upward from, and surrounding, said bottom surface, said side portion terminating in an exterior edge of a uniform height above said bottom surface and said exterior edge defining an opening having a first predetermined size and shape;

a stiff diaphragm having an outer edge, a top surface and a bottom surface; said stiff diaphragm has a second size that is smaller than said first size and is substantially the same shape as said opening defined by the exterior edge of the frame;

a first flexible suspension surrounding the outer edge of the diaphragm having an inner edge attached to the outer edge of the diaphragm and an outer edge attached to the exterior edge of the frame, with the combination of said diaphragm and first suspension having a size and shape that is substantially the same as the first size and shape;

an audio motor including:

a magnet mounted centrally to the bottom surface of the frame;

a thin walled bobbin having a first length, a first diameter, and first and second ends; and a voice coil wound closest to the first end of the bobbin;

wherein the second end of the bobbin is attached centrally to the bottom surface of the diaphragm to move the stiff diaphragm, when the first suspension is coupled to the frame, inward and outward relative to the bottom surface of the frame in response to an electrical signal applied to the voice coil that interacts with the magnet to move the bobbin;

a first cylinder having a second length that is shorter than the first length, and an inner diameter that is larger than the combined first diameter of the bobbin and a thickness of the voice coil wound thereon; and a second flexible suspension attached to, and surrounding, an outer surface of said first cylinder, and extending and attached to a point on an interior surface of the side portion of the frame between the exterior edge and the bottom surface of the frame;

wherein when the loudspeaker is assembled the end of the bobbin with the voice coil thereon extends through the first cylinder and interacts with the magnet.

2. A loudspeaker as in claim 1 wherein the combination of said diaphragm and first flexible suspension is removably attached to the exterior edge of the frame.

3. A loudspeaker as in claim 2 further includes an elastic ring located around the exterior edge of the frame with the outer edge of the first flexible suspension between the elastic ring and the exterior edge of the frame.

4. A loudspeaker as in claim 1 wherein said bobbin is removably attached to said diaphragm.

5. A loudspeaker as in claim 1 wherein:

said loudspeaker further includes a second cylinder having first and second ends, a third length that is shorter than said first length and a second diameter that is greater than said first diameter, with said first end connected to the bottom surface of the diaphragm concentrically with, and encircling said first end of, the bobbin, wherein an inner surface of the second end of the first cylinder is threaded; and an end of said first cylinder is externally threaded to mate with the threaded portion of said second cylinder closest to said exterior edge of the frame when the loudspeaker is assembled.

6. A loudspeaker as in claim 5 wherein the combination of said diaphragm and first flexible suspension is removably attached to the exterior edge of the frame.

7. A loudspeaker as in claim 6 further includes an elastic ring located around the exterior edge of the frame with the outer edge of the first flexible suspension between the elastic ring and the exterior edge of the frame.

8. A loudspeaker as in claim 5 wherein said bobbin is removably attached to said diaphragm.

9. A loudspeaker as in claim 5 wherein:

the threaded end of said first cylinder includes a first bifurcated, externally threaded ring affixed to the first cylinder, the first bifurcated ring includes two electrically conductive portions and two non-conductive portions alternately around the edge of the first cylinder;

the second end of said second cylinder includes a second bifurcated, internally threaded ring affixed to the second cylinder, the second bifurcated ring includes two electrically conductive portions and two non-conductive portions alternately around the edge of the second cylinder;

said voice coil being an electrically conductive wire coil with the coil having two free ends, said two free ends of wire dressed to the second end of the bobbin, then to the first end of the second cylinder and then to the second end of the second cylinder with each of the wire free ends in electrical contact with a different one of two electrically conductive portions of the second ring;

said loudspeaker further including:

a pair of electrically conductive wires dressed across said second suspension toward the frame; and a pair of terminals mounted on the frame each connected to a different one of the wires dressed across said second suspension toward the frame with said terminals disposed to be connected to an amplifier to receive electrical signals to drive said voice coil; and when said loudspeaker is assembled first and second cylinders are aligned one with the other with the first and second conductive portions of the first ring being in contact with a different one of the first and second conductive portions of the second ring.

10. A loudspeaker as in claim 5 wherein:

said first cylinder includes two electrically conductive cylinder portions and two non-conductive cylinder portions alternately therearound forming the first cylinder;

said second cylinder includes two electrically conductive cylinder portions and two non-conductive cylinder portions alternately therearound forming the second cylinder;

said voice coil being an electrically conductive wire coil with the coil having two free ends, said two free ends of wire dressed to the second end of the bobbin and then to the first end of the second cylinder with each of the wire free ends in electrical contact with a different one of two electrically conductive cylinder portions of the second cylinder;

said loudspeaker further including:

a pair of electrically conductive wires dressed across said second suspension toward the frame; and a pair of terminals mounted on the frame each connected to a different one of the wires dressed across said second suspension toward the frame with said terminals disposed to be connected to an amplifier to receive electrical signals to drive said voice coil; and when said loudspeaker is assembled first and second cylinders are aligned one with the other with the first and second conductive cylinder portions of the first cylinder being in contact with a different one of the first and second conductive cylinder portions of the second cylinder.

* * * * *